US007397175B2

(12) United States Patent
Hwu et al.

(10) Patent No.: US 7,397,175 B2
(45) **Date of Patent: *Jul. 8, 2008**

(54) SOLID STATE VACUUM DEVICES

(76) Inventors: Ruey-Jen Hwu, 3767 E. Brockbank Dr., Salt Lake City, UT (US) 84124; Larry Sadwick, 3767 E. Brockbank Dr., Salt Lake City, UT (US) 84124

( * ) Notice: Subject to any disclaimer, the term of this patent is extended or adjusted under 35 U.S.C. 154(b) by 135 days.

This patent is subject to a terminal disclaimer.

(21) Appl. No.: 11/348,959

(22) Filed: Feb. 7, 2006

(65) Prior Publication Data

US 2006/0125368 A1 Jun. 15, 2006

Related U.S. Application Data

(63) Continuation of application No. 10/067,616, filed on Feb. 4, 2002, now Pat. No. 6,995,502, and a continuation of application No. 10/067,625, filed on Feb. 4, 2002, now Pat. No. 7,005,783.

(51) Int. Cl.
*H01J 1/46* (2006.01)
*H01J 21/10* (2006.01)

(52) U.S. Cl. ..... 313/293; 313/310; 313/296

(58) Field of Classification Search ..... 313/310, 313/233, 293, 296–299; 257/13, 83, 86
See application file for complete search history.

(56) References Cited

U.S. PATENT DOCUMENTS 4,263,528 A * 4/1981 Miram ..... 313/293
5,475,281 A * 12/1995 Heijboer ..... 313/337
5,686,790 A * 11/1997 Curtin et al. ..... 313/493
6,465,132 B1 * 10/2002 Jin ..... 429/231.8

* cited by examiner

*Primary Examiner*—Peter Macchiarolo
(74) *Attorney, Agent, or Firm*—Morriss O'Bryant Compagni

(57) ABSTRACT

A solid-state vacuum device (SSVD) and method for making the same. In one embodiment, the SSVD forms a triode device comprising a substrate having a cavity formed therein. The SSVD further comprises a cathode positioned near the opening of the cavity, wherein the cathode spans over the cavity in the form of a bridge that creates an air gap between the cathode and substrate. In addition, the SSVD further comprises an anode and a grid that is positioned between the anode and cathode. Upon applying heat to the cathode, electrons are released from the cathode, passed through the grid, and received by the anode. In response to receiving the electrons, the anode produces a current. The current received by the anode is controlled by a voltage applied to the grid. Other embodiments of the present invention provide diode, tetrode, pentode, and other higher order device configurations.

20 Claims, 21 Drawing Sheets

SOLID STATE VACUUM DEVICES

CROSS-REFERENCE TO RELATED APPLICATIONS

This continuation application claims benefit of U.S. patent application Ser. No. 10/067,616 now U.S. Pat. No. 6,995,502, and U.S. Ser. No. 10,067,616 now U.S. Pat No. 7,005,783, both filed contemporaneously on Feb. 4, 2002, the contents of which are incorporated herein by reference for all purposes.

FIELD OF THE INVENTION

The present invention relates to semiconductor devices and vacuum devices, and in particular, to devices configured to operate in a vacuum environment and devices manufactured through microelectronic, micro electromechanical systems (MEMS), micro system technology (MST), micromachining, and semiconductor manufacturing processes.

BACKGROUND OF THE INVENTION

Vacuum tubes were developed at or around the turn of the century and immediately became widely used for electrical amplification, rectification, oscillation, modulation, and wave shaping in radio, television, radar, and in all types of electrical circuits. With the advent of the transistor in the 1940s and 1950s and integrated circuit technology in the 1960s, the use of the vacuum tube began to decline, as circuits previously employing vacuum tubes were adapted to utilize solid-state transistors. The result is that today more circuits are utilizing solid-state semiconductor devices, with vacuum tubes remaining in use only in limited circumstances such as those involving high power, high frequency, or hazardous environmental applications. In these limited circumstances, solid-state semiconductor devices generally cannot accommodate the high power, high frequency or severe environmental conditions.

There have been a number of attempts at fabricating vacuum tube devices using solid-state semiconductor device fabrication techniques. One such attempt resulted in a thermionic integrated circuit formed on the top side of a substrate, with cathode elements and corresponding grid elements being formed co-planarly on the substrate. The anodes for the respective cathode/grid pairs were fabricated on a separate substrate, which was aligned with the first-mentioned substrate such that the cathode to anode spacing was on the order of one millimeter. With this structure, all the cathode elements were collectively heated via a macroscopic filament heater deposited on the backside of the substrate. Accordingly, this structure required a relatively high temperature operation and the need of substrate materials having high electrical resistivity at elevated temperatures. Among the problems with this structure were inter-electrode electron leakage, electron leakage between adjacent devices, and functional cathode life.

SUMMARY OF THE INVENTION

The present invention provides a solid-state vacuum device (SSVD) that operates in a manner similar to that of a traditional vacuum tube. Generally described, one embodiment of an SSVD comprises a cathode, anode, and a grid. In alternative embodiments, the SSVD also comprises a plurality of grid layers, also referred to as a plurality of electrodes, for forming other higher order SSVD's. In several embodiments, the cathode is heated by a structure via a circuit that causes the cathode to emit electrons; this configuration is referred to as an indirectly heated cathode. In another configuration, which is referred to as a directly heated cathode, the heater circuit provides energy/power to a structure that is directly part of and in electrical contact with the cathode and it emits electrons when it is heated. Other possible electron emission mechanisms include photo-induced emission, electron injection, negative affinity, and any other mechanisms known in the art. As can be appreciated by one of ordinary skill in the art, these electron emission mechanisms can also be used separately or in conjunction with the thermionic emission. The electrons are passed through the grid and received by the anode. In response to receiving the electrons from the cathode, the anode produces a current that is fed into an external circuit. The magnitude of the flow of electrons through the grid is regulated by a control circuit that supplies a voltage to the grid. Accordingly, the voltage applied to the grid controls the electrical current received by the anode.

In one embodiment, the present invention provides an SSVD in a triode configuration. In this embodiment, the SSVD comprises a substrate having a cavity formed into the substrate. The SSVD further comprises a cathode positioned near the opening of the cavity formed in the substrate, an anode suspended over the cathode and a grid positioned between the cathode and anode. The grid comprises at least one aperture for directing the passage of electrons traveling from the cathode to the anode. The grid is made from a conductive material. In addition, the SSVD comprises an enclosed housing for creating a controlled environment in an area surrounding the grid, cathode, and anode. In one embodiment, the controlled environment is a vacuum environment, which allows for electron flow between the cathode, grid and anode.

In one embodiment, the cathode is in the form of a suspended bridge, referred to as an "air bridge," which functions as a thermal barrier between the cathode and substrate. The air bridge is suspended over a cavity formed in a substrate, leaving an open area between the cathode and the substrate. In one embodiment, the air bridge, having a substantially rectangular shape, is supported at opposite ends. In another embodiment, the air bridge is supported at one end, thereby forming an air bridge structure having at least three suspended sides. In one embodiment, the air bridge creates an air gap of about 5 to 10 microns between the cathode and the substrate. By the use of the fabrication processes described below, a diode, triode or other higher order device configurations having a suspended air bridge structure can be manufactured.

In one specific embodiment, the present invention provides an SSVD in a diode configuration. In this embodiment, the SSVD comprises a substrate having a cavity formed into the substrate. The SSVD further comprises a cathode in the form of an air bridge suspended over the cavity of the substrate. This embodiment further comprises an anode suspended over the cavity where the anode is positioned and configured to receive electrons from the cathode. This embodiment of the SSVD also comprises an enclosed housing for creating a controlled environment surrounding the cathode and anode.

In other embodiments, the present invention provides a number of higher order devices such as a tetrode and pentode. In these embodiments, the SSVD comprises a substrate having a cavity formed in the substrate. These embodiments further comprise a cathode in the form of an air bridge, an anode positioned over the cathode, and a plurality of grid layers positioned between the cathode and anode. More specifically, the tetrode configuration comprises two grid layers, and the pentode configuration comprises three grid layers. In the tetrode configuration, the SSVD comprises two aligned grid layers to provide an increased power generation capacity that is characteristic of a pentode. The grid layers of these alternative embodiments comprise at least one aperture for directing the passage of electrons from the cathode to the anode. By the use of novel fabrication methods of the present invention, other higher order devices may be constructed by providing additional grid layers to the SSVD structures described herein.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings.

DETAILED DESCRIPTION OF THE PREFERRED EMBODIMENT

The present invention provides a sub micron-scale to cm-scale and beyond solid-state vacuum device that operates in a manner similar to that of e traditional vacuum tube devices. As described below, the present invention includes a plurality of embodiments where a device is configured to form a diode, triode, tetrode, pentode or other higher order devices made from novel semiconductor fabrication techniques. The following sections provide a detailed description of each embodiment and several fabrication methods for making the devices disclosed herein.

Figure 1:
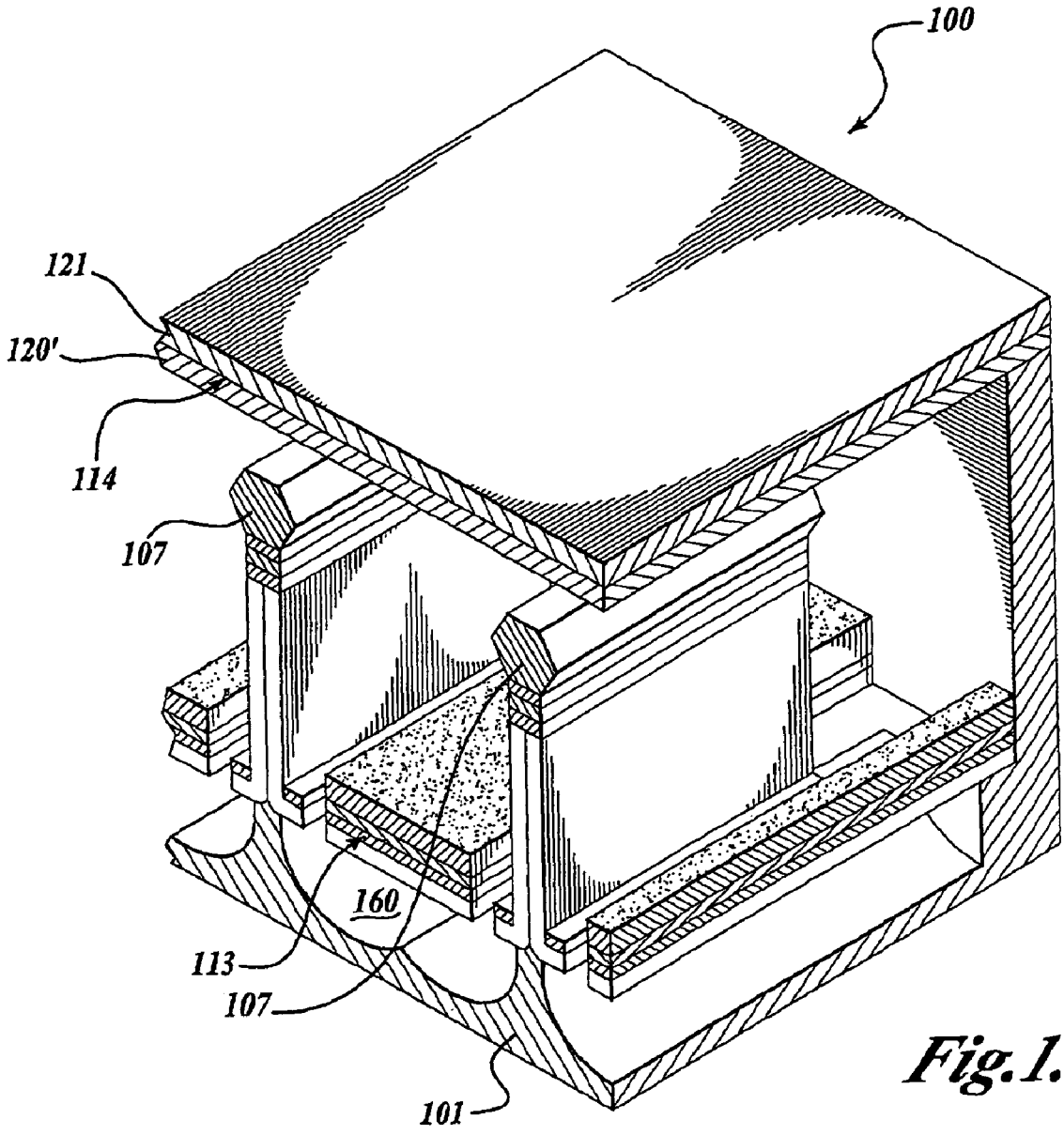
FIG. 1 is a top front cross-sectional perspective view of one embodiment of a device in accordance with the present invention.

Referring now to FIG. 1, the basic elements of one embodiment of a triode solid state vacuum device 100 (hereinafter referred to as the triode 100) are shown. Generally described, the triode 100 comprises a substrate 101 having a cavity 160 formed in the substrate 101. The triode 100 further comprises a cathode 113 positioned near the opening of the cavity 160. As described in detail below, the cathode 113 is in the form of an air bridge structure that spans over the opening of the cavity 160. The triode 100 further comprises an anode 114 that is vertically positioned above the cathode 113, and a grid 107 positioned between the cathode 113 and anode 114. Also shown in FIG. 1, the triode 100 comprises an enclosed housing for creating a controlled environment in an area surrounding the cathode 113, anode 114 and grid 107. A controlled environment, such as a vacuum environment, allows charged carriers to move between the cathode 113, anode structure 114 and grid 107.

In the operation of the triode 100, the cathode 113 is heated by a circuit that causes the cathode 113 to emit charged carriers, such as electrons. The emitted electrons pass through apertures in the grid 107 and received by the anode 114. In response to receiving the electrons from the cathode 113, the anode 114 produces a current. The magnitude of the flow of electrons through the grid 107 is controlled by a circuit that supplies a voltage to the grid 107. Accordingly, the voltage applied to the grid 107 controls the electrical current received by the anode 114.

Figure 2:
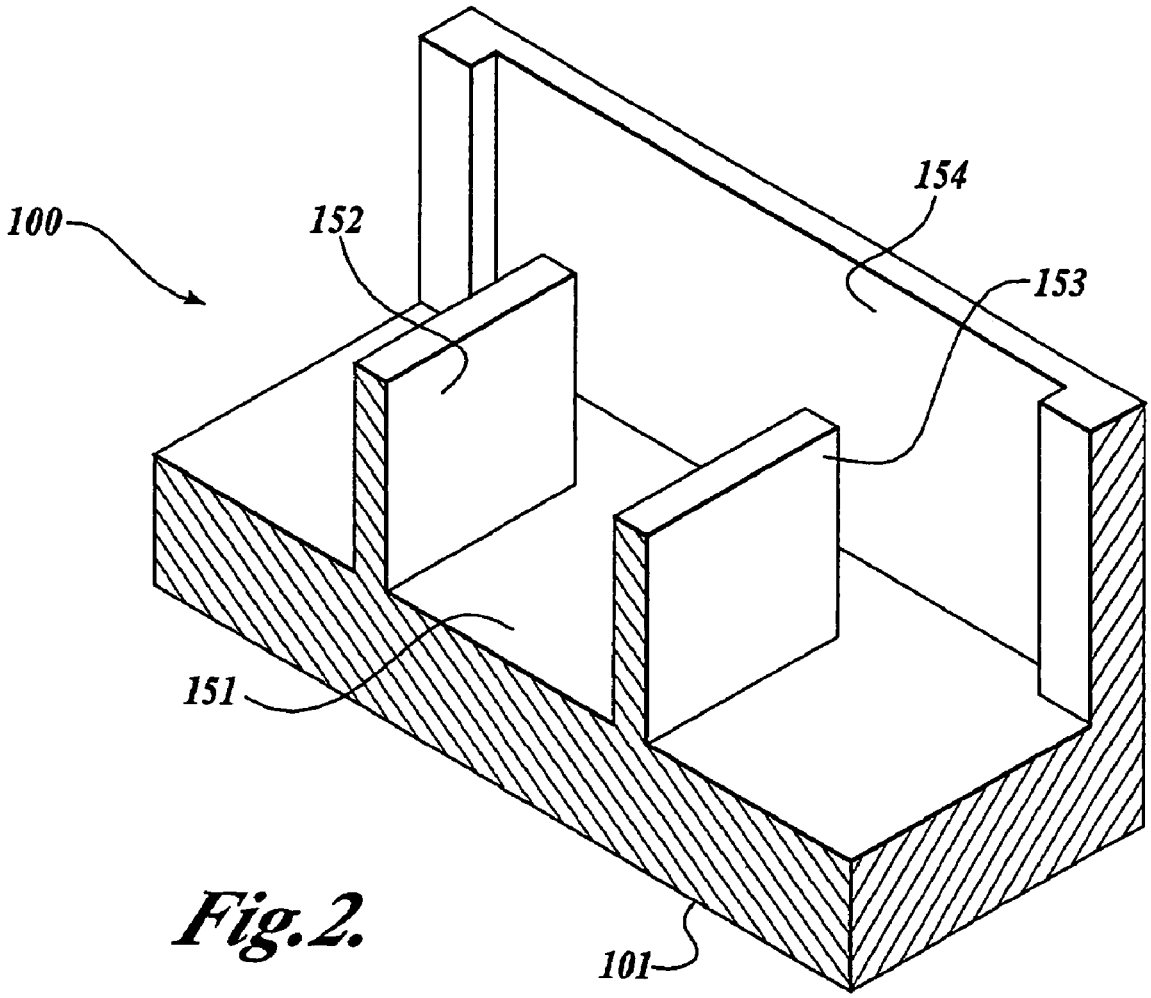
FIG. 2 is a top front cross-sectional perspective view of a formed substrate utilized in one embodiment of the device shown in FIG. 1.
Figure 3A:
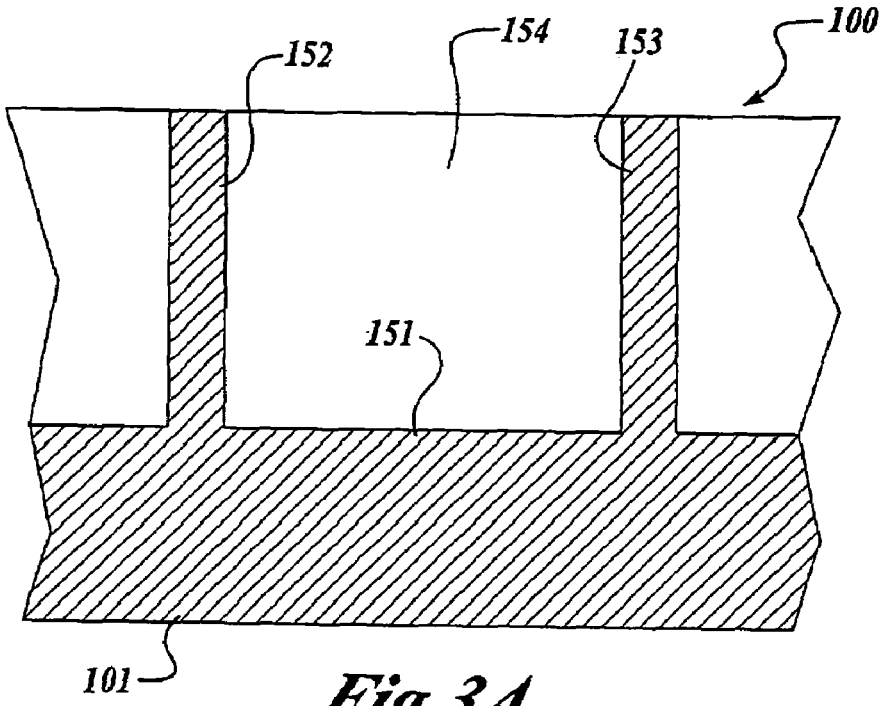
FIGS. 3A-3D illustrate several steps employed in one embodiment of a fabrication process for forming the device depicted in FIG. 1.
Figure 3B:
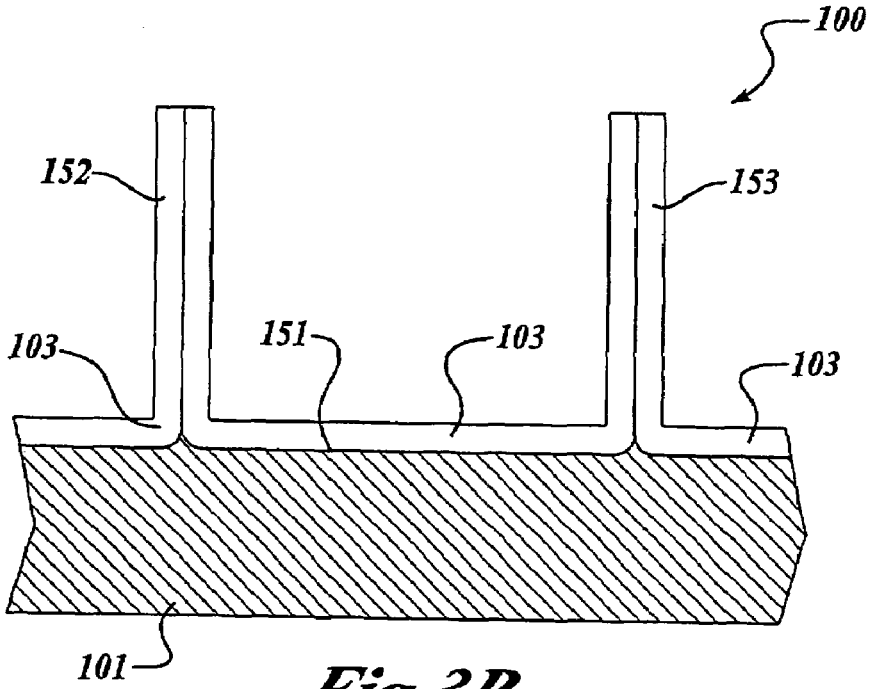
Figure 3C:
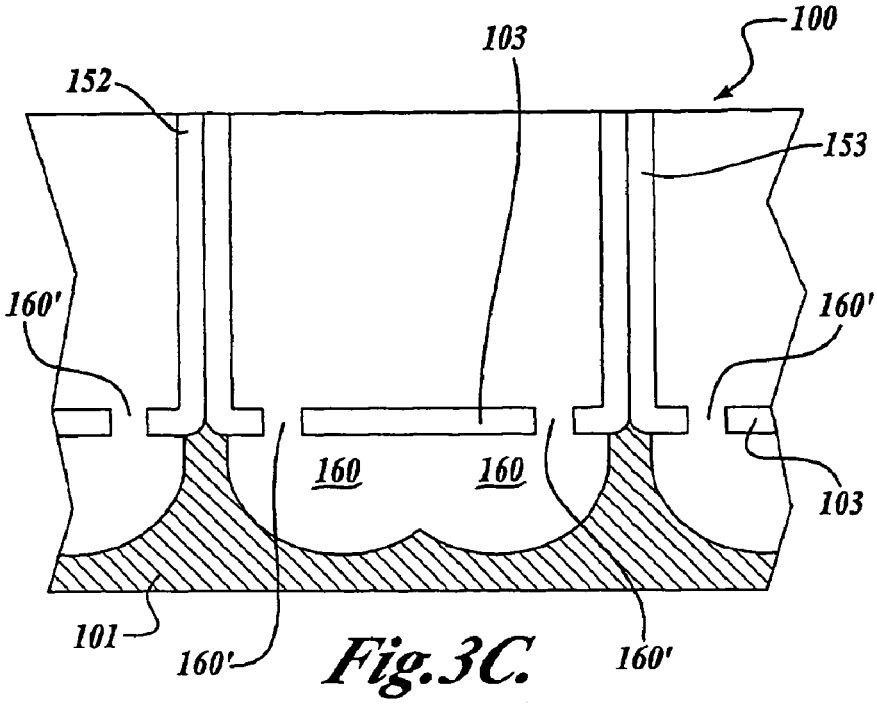
Figure 3D:
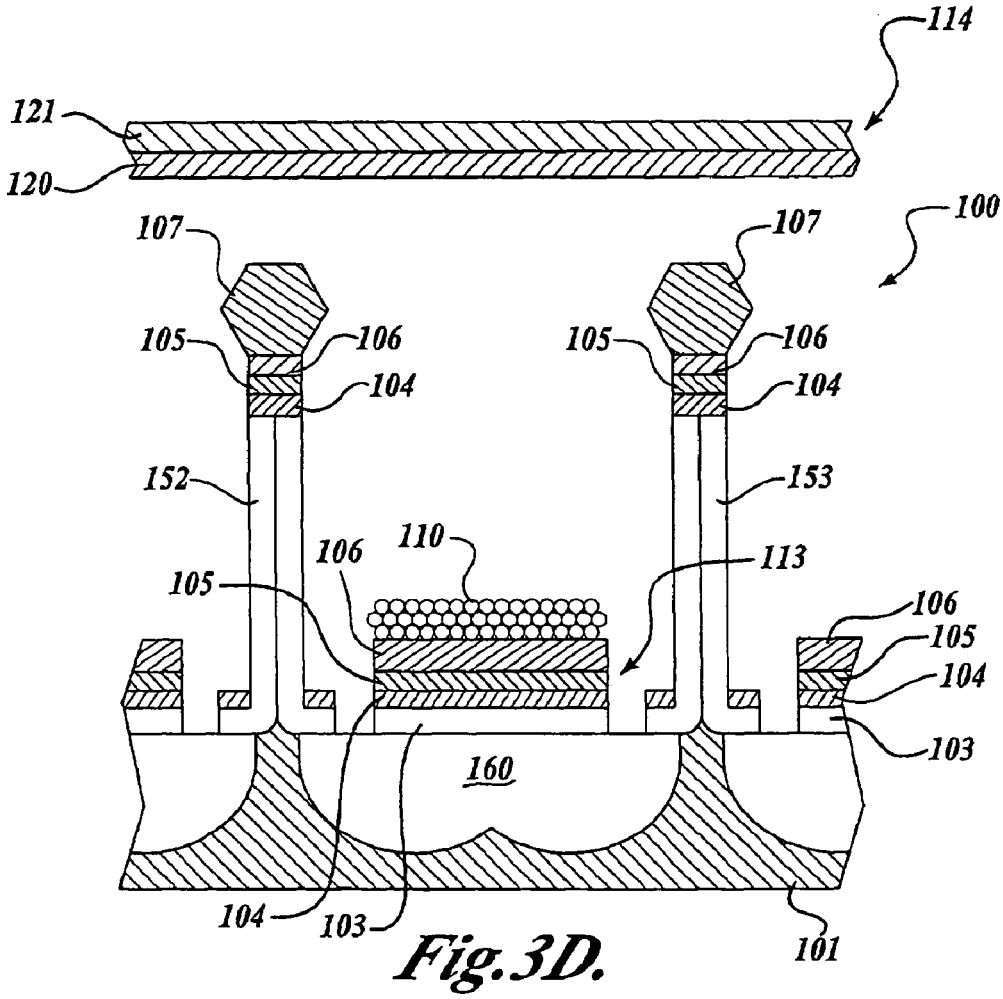

Referring now to FIGS. 2-3D, one embodiment of a fabrication process forming the triode 100 (FIG. 1) is shown and described below. FIG. 2 is a top, front perspective view of one embodiment of a formed substrate 101 utilized in the construction of the triode 100. The formed substrate 101 comprises a first support 152, second support 153, supporting wall 154 and a base 151. In one illustrative embodiment, the first and second supports 152 and 153 are each formed into a generally elongated ridge-shaped structure having a top surface sized to support device components disposed thereon. In this embodiment, the ridge formed by the first support 152 is substantially parallel to the ridge formed by the second support 153. In addition, each support 152 and 153 may be similar or, in many embodiments, identical in size and dimension. Also shown in the front sectional view of FIG. 3A, the cross-section of each support 152 and 153 may be in a rectangular shape that extends in a vertical direction away from the top surface of the substrate 101. Although the illustrative embodiment shown in FIG. 2 comprises only two supports 152 and 153, other embodiments having more than two supports, such as an array of supports, are within the scope of the present invention. In addition, although the example of FIG. 2 illustrates one embodiment having the supports 152 and 153 on the top side of the substrate 101, the supports 152 and 153, and the other components of the triode 100, may be oriented on any one side or multiple sides of the substrate 101. As shown in FIGS. 2 and 3A, the base 151 forms a substantially flat surface on the top of the substrate 101 between the first support 152 and second support 153. The base 151 is preferably formed into a flat surface that defines a plane that is substantially perpendicular to the planes defined by the supports 152 and 153. In addition, the plane defined by the top surface of the base 151 is substantially perpendicular to a plane defined by the vertical surface of the supporting wall 154. Although this illustrative embodiment shows first and second supports 152 and 153 having a substantially rectangular cross-section, supports having any other shape, including circles or triangles, capable of supporting raised conductive layers are well within the scope of the present invention.

The supporting wall 154 functions as a barrier to create a closed environment surrounding the device components that are positioned near first and second supports 152 and 153. As shown in FIG. 1, a closed environment is formed when the anode 114, also referred to as an anode structure, is affixed on the supporting wall 154. Accordingly, as suggested by the cut-away section, the supporting wall 154 may be configured to surround the entire perimeter of the top surface of the base 151 to provide the enclosed environment around the device components positioned near the first and second supports 152 and 153. In one embodiment, the supporting wall 154 is formed into a substantially flat, vertically aligned surface that is formed as part of the base substrate 101. In another embodiment, the supporting wall 154 is formed from a separate substrate component that is affixed on the top surface of the base 151. The supporting wall 154 can be made from any material and formed into any shape that sufficiently creates a controlled environment around the device components. In addition, it is preferred that the supporting wall 154 is formed into a structure that sufficiently holds the anode structure 114 in position.

The first support 152, second support 153, and the supporting wall 154 may be formed by any known fabrication method. In one embodiment, the formed substrate 101 may be shaped by a dry etching process. In other examples, the substrate 101 may be shaped by glow-discharge, sputtering, chemical based etching, or a combination of glow-discharge, sputtering or chemical based etching. In another embodiment, additive processes can be used to shape the substrate 101.

The substrate 101, also referred to as the base substrate, can be made from any material such as a polycrystalline material, an amorphous material, a variety of silicon type materials or other suitable substrate material having the ability for appropriate properties including, in many cases, insulating properties. For example, the substrate 101 may be made of glass, sapphire, quartz, plastic, oxidized polycrystalline silicon, oxidized amorphous silicon, silicon, silicon dioxide, silicon nitride, magnesium oxide, gallium arsenide semiconductor substrates or any other material having like properties. Alternatively, the substrate 101 may comprise a conductive material and insulating layer disposed on the conductive material.

As shown in FIGS. 3B-3D, the formation of specific components of the triode 100 are shown and described below. The scale of the device components illustrated in these figures are enlarged to better illustrate the fabrication process of the present invention. It is to be appreciated by one of ordinary skill in the art that each component described below and illustrated in these figures may be made in any scale without departing from the scope of the present invention.

Referring now to FIG. 3B, one embodiment of the triode 100 comprises an oxidation layer 103 disposed on the substrate 101. In one embodiment, the oxidation layer 103 is a silicon dioxide ($SiO_2$) layer disposed on the substrate 101. The oxidation layer 103 may be applied to the substrate 101 by the use of any generally known fabrication method such as wet or dry oxidation, sputtering evaporation, or any other like method. As shown in FIG. 3B, the oxidation layer 103 is deposited on the substrate 101 in a substantially uniform layer over the surface of the formed substrate 101. More specifically, in one embodiment, the oxidation layer 103 may be uniformly applied over the vertically aligned surfaces of the first and second supports 152 and 153. In addition, the oxidation layer 103 is also uniformly applied to the top surface of the base 151 of the substrate 101. In one embodiment, the oxidation layer 103 may be applied on the substrate 101 having a thickness between 1000 Angstroms to 1 cm. Although this illustrative embodiment comprises an oxidation layer 103 having a thickness in a specific range, any thickness and/or dimension of the oxidation layer may be used without departing from the scope of the present invention.

As shown in FIG. 3C, the triode 100 further comprises a cavity 160 formed underneath the oxidation layer 103. In one embodiment, the cavity 160 is formed by first etching a plurality of slotted cavities 160' in the oxidation layer. As shown in FIG. 3C, the slotted cavities 160' are positioned near the base of each support grid 152 and 153 and each slotted cavity 160' is formed into an elongated groove that extends along the side of each support 152 and 153. Referring to FIG. 4B, a top view of one embodiment of the slotted cavities 160' is shown, where each slotted cavity 160' is shaped into an elongated groove that is positioned along the side of each support 152 and 153. Also shown in FIG. 4B, the slotted cavities 160' isolate a rectangular section of the oxidation layer 103 between the first and second grid supports 152 and 153. As will be described in more detail below, the isolated section of the oxidation layer 103 creates a surface for the mounting of the cathode 113 components (see FIG. 3D).

Referring again to FIG. 3C, once the slotted cavities 160' are formed, a cavity 160 is formed underneath the isolated section of the oxidation layer 103. As shown, the cavity 160 is configured to form an air gap under the isolated section of the oxidation layer 103, thereby creating an air bridge structure for suspending the cathode 113 (see FIG. 3D). As described above, the air gap created by the cavity 160 provides thermal insulation between the cathode 113 and substrate 101.

The slotted cavities 160' in the oxidation layer 103 can be formed by any generally known fabrication process for creating shaped cavities in an unoxidized material or an oxidation material. The cavity 160 can be formed by any generally known fabrication process that is suitable for removing large volumes of substrate material underneath a thin surface layer, such as oxidation layer 103. In one embodiment, the cavity 160 may be formed by a bulk micromachining technique. For example, if the substrate 101 is made from single-crystal silicon, the bulk micromachining is achieved by anisotropic, isotropic wet etching or plasma dry etching techniques.

In the method involving anisotropic wet etching, generally accepted etching solutions for silicon may be used. For example, potassium hydroxide (KOH), hydrazine ($N_2H_2$), and ethylene diamine pyrocatechol/water (EDP)/$H_2O$ may be utilized in this embodiment. As can be appreciated by one of ordinary skill in the art, the etching rate of certain solutions is more effective in a vertical direction compared to the etching rate in a horizontal direction. Also known in the art, the selectivity of a solution is defined as the ratio of the etch rate in a desired direction in relation to the etch rate in an undesired direction. In one embodiment of the fabrication process, a weight percentage of KOH of 22.5% in a water solution at 80° C. may yield a selectivity of 108. A solution having this selectivity may be used to form the cavity 160 as shown in FIG. 3C. To further control the shape of the cavity 160, areas of a silicon substrate material may be doped with boron to reduce the etching rate in specific regions. For example, the substrate material under the supports 152 and 153 may be doped with boron to provide additional support in those areas of the substrate 101 during the etching process.

In another embodiment, a dry etching fabrication process may be utilized to create the cavity 160. As can be appreciated by one of ordinary skill in the art, there are many types of dry etching including sputtering etching, wet chemical etching, and dry plasma etching. A combination of these methods may also be employed and utilized.

Referring now to FIG. 3D, the fabrication process for forming the cathode 113 and grid 107 is shown and described. As shown in FIG. 3D, after the cavity 160 is created in the substrate 101, the fabrication process involves the application of a first conductive layer 104. In this part of the process, the first conductive layer 104 is applied directly onto the horizontal surfaces of the oxidation layer 103. As shown in FIG. 3D, one embodiment of the triode 100 involves the application of the first conductive layer 104 on the top surface of the isolated section of the oxidation layer 103 and on the top surfaces of each support 152 and 153. As described above, the top surface of each support 152 and 153 forms a substantially flat surface for supporting the application of additional device components. Accordingly, the first conductive layer 104 may be uniformly applied to the top of each support 152 and 153 in a process that is similar to the application of the oxidation layer 103.

In one embodiment, the first conductive layer 104 may be made from a high temperature, electrically conductive material such as tungsten, nickel, molybdenum, platinum, tantalum, titanium, semimetal, semiconductors, silicides, polysilicon, alloys, intermetallics, or any other like material. As known to one of ordinary skill in the art, the first conductive layer 104 may be deposited on the oxide layer 103 by the use of any fabrication process such as physical vapor deposition (PVD), metal sputtering, chemical vapor deposition (CVD) or a process employing beam evaporation. In one embodiment, the first conductive layer 104 may be configured to have a thickness of 100 Angstroms or less. In other embodiments, the first conductive layer 104 may have a thickness in a range of one micron to one millimeter. Although these dimensions are used in this illustrative embodiment, the first conductive layer 104 may be configured to any thickness to accommodate any desired design specification.

Once the first conductive layer 104 is deposited onto the oxidation layer 103, the fabrication process involves the application of an insulating layer 105. As illustrated in FIG. 3D, the insulating layer 105 is deposited directly onto the horizontal surfaces of the first conductive layer 104. More specifically, the insulating layer 105 is disposed on the surface between the first and second supports 152 and 153, and also, the insulating layer 105 may be optionally disposed on the supports 152 and 153. In addition, the insulating layer 105 is disposed on the top surfaces of each support 152 and 153. In one embodiment, the insulating layer 105 is deposited directly onto the first conductive layer 104.

The insulating layer 105 can be made from any material having electrically resistive properties. For example, the insulating layer 105 may be made from ceramic, silicon dioxide, or the like. As can be appreciated by one of ordinary skill in the art, the insulating layer 105 may be deposited onto the conductive layer 104 by the use of any known fabrication method such as oxidation, sputtering, evaporation, or any other like method.

The first conductive layer 104 functions as an electrical heater to heat an electron-emitting material 110 deposited on the air bridge structure. In one embodiment, the first conductive material 104 may be made of a low resistance metal that rises to high temperatures when a voltage source is applied thereto. Several examples of a low resistance metal providing a thermal source include metals such as tungsten, molybdenum, tantalum, platinum, alloys, intermetallics, or the like. Although these low resistance metals are used in this illustrative example, any other appropriate resistance metals for creating a heat source may be used in the construction of any one of the devices disclosed herein. The insulating layer 105 may be applied by a number of known fabrication methods, such as sputtering. In one embodiment, the insulating layer 105 has a thickness in the range of much less than one micron to one millimeter. Although this range is used in this illustrative embodiment, the insulating layer 105 may be formed to any other desired thickness greater or less than this range. Referring again to FIG. 3D, the fabrication process of the triode 100 further comprises the application of a second conducting layer 106. In one embodiment, the second conducting layer 106 is deposited directly onto the surface of the insulating layer 105. As can be appreciated by one of ordinary skill in the art, any form or thickness of the second conducting layer 106 conforms to the scope of the present invention.

Also shown in FIG. 3D, the fabrication process of the cathode 113 further comprises the application of an electron-emitting material 110. As shown in FIG. 3D, the electron-emitting material 110 is selectively disposed onto the surface of the second conducting layer 106 thereby forming the entire cathode structure 113. The electron-emitting material 110 may be made of any material with a suitably low work function for producing emissions of charged carriers, e.g., electrons. In one embodiment, the electron-emitting material 110 may be a carbonate of several elements, such as barium, strontium, and calcium. Although these materials are used in this illustrative example, any material with a suitably low work function may be used in the construction as the emitting material of the triode 100. The electron-emitting material 110 may be formed and selectively removed from the device by the use of conventional semiconductor, micromachining, microelectromechanical systems (MEMS), or micro system technology (MST) processing techniques, including such techniques as patterning, etching, and lift-off. Alternatively, the electron-emitting material 110 may be sprayed onto the conducting layer 106. In one embodiment, the electron-emitting material 110 is a mixture of barium carbonate, strontium carbonate and calcium carbonate in 45:51:4 percent by weight ratio.

Although the cathode 113 shown in FIG. 3D is disclosed as one illustrative embodiment of the present invention, the cathode 113 may comprise a variety of layers or combination of layers to form the air bridge structure of the cathode 113. For instance, it may be possible to utilize the electron-emitting material 110, also referred to as the low work function material, without the second conducting layer 106. This embodiment may be used depending on the nature and application of the low work function material.

In another alternative embodiment, the cathode 113 may be configured with two conductive layers interlaced with two insulating layers. In this alternative embodiment, the thermal heat source indirectly applies heat to the electron-emitting material of the cathode via an insulating layer. The cathode 113 first comprises a first insulating layer that forms the bottom of the air bridge structure. The first insulating layer may be formed in a shape and thickness similar to the configuration of the oxidation layer 103 shown in FIG. 3D. Next, a first conductive layer is disposed directly onto the first insulating layer. The first conductive layer of this embodiment is made of any material that functions as a thermal source, such as the above-described second conductive layer (105 of FIG. 3D). Next, a second insulating layer is disposed directly onto the first conductive layer. Preferably the insulating layer has a good thermal conductivity to transfer heat to the cathode base layer, second conducting layer. In this embodiment, the second insulating layer may be made of any material having electrically resistive properties such as aluminum oxide, silicon nitride, silicon dioxide or any other like material. Disposed directly onto the second insulating layer is a second conductive layer. The second conductive layer is preferably made from a conductive material such as nickel or tungsten. The second conductive layer can be formed into one continuous layer covering the second insulating layer, thereby providing a foundation for the application of the electron-emitting material. Accordingly, the electron-emitting material is disposed on the second insulating layer by the use of any process or processes including one of the above-described fabrication processes.

In another embodiment involving an indirect method of heating the electron-emitting material, the cathode structure 113 comprises a single insulating layer sandwiched between two conductive layers. In this embodiment, the first conductive layer is formed as the bottom of the air bridge structure. Hence, the first conductive layer may be formed in a shape and thickness similar to the configuration of the oxidation layer 103 shown in FIG. 3D. In this embodiment, the first conductive layer functions as the thermal source for the cathode 113. Thus, the first conductive layer may be made from any material that acts as a thermal source when a voltage is applied thereto. Next, an insulating layer is disposed directly onto the first conductive layer. The insulating layer of this embodiment electrically isolates the first conductive layer from other components of the cathode, and is preferably made from the material with suitable heat transfer properties. Disposed directly onto the insulating layer of this embodiment is a second conductive layer. The second conductive layer of this embodiment may be made from any electrically conductive material such as tungsten or nickel, appropriate constitutes added to nickel, and other suitable base metals. Next, the electron-emitting material is disposed directly onto the second conductive layer by, for example, the use of any one of the above-described fabrication processes.

Alternatively, the cathode 113 may comprise several embodiments where a conductive layer directly applies heat to the electron-emitting material. For instance, in one embodiment, the cathode 113 is constructed from a single layer of conductive material, which forms the entire air bridge structure. Similar to the second conductive layer 106 described above with reference to FIG. 3D, the single conductive layer of this embodiment is made from any material that functions as a thermal source and a base cathode layer when a voltage and current is applied thereto. To complete this embodiment of the cathode, a layer of electron-emitting material is disposed directly onto the single conductive layer.

In another embodiment employing a direct method of heating the electron-emitting material, the air bridge structure of the cathode 113 may be made of a single insulating layer and a signal conductive layer. In this embodiment, the insulating layer is configured to form the bottom of the air bridge structure. The single insulating layer of this embodiment is formed in a shape and configuration similar to the oxidation layer 103 shown in FIG. 3D. Next, a single conductive layer is disposed on the single insulating layer. In this embodiment, the single conductive layer functions as a thermal source for the cathode. Next, the electron-emitting material is disposed directly onto the conductive layer of this embodiment.

Referring again to FIG. 3D, the triode 100 further comprises a grid 107, also referred to as an electrode, that is formed on the top of each support 152 and 153. In one embodiment, the grid 107 is shaped into a number of elongated conductive strips that are selectively disposed, for example, onto the insulating layer 106 or conducting layer 105 positioned on the top of each support 152 and 153. With reference to FIGS. 1 and 3D, one embodiment of the grid 107 is configured to have a hexagonal section. Although this illustrative embodiment discloses a grid 107 having a generally hexagonal or rounded shape, the grid 107 may be formed in any shape that allows the grid 107 to influence the flow of electrons between the cathode and anode. For example, the grid 107 may include any general shape such as a parallelepiped, spherical, cylindrical, or any appropriate geometrical shape. In one embodiment, as illustrated by the embodiment shown in FIGS. 1 and 3D, the grid 107 is formed to extend over the top edge of each support 152 and 153. In one embodiment, the grid 107 is constructed from an electrically conductive material. For instance, in several examples, the grid 107 may be made of tungsten, gold, tantalum, platinum, nickel, or any other material or combination thereof.

The grid 107 may be formed by the use of any known fabrication process for making or shaping formed, metallic layers. In one embodiment, the grid 107 is formed by the use of a sputtering, evaporation, or CVD technique combined with a photo-resistive material shaped by a mask. As can be appreciated by one of ordinary skill in the art, the fabrication process of the grid 107 may comprise a plurality of fabrication steps utilizing several masks to achieve the rounded shape of the grid 107. In other embodiments, the grid 107 may be formed by an electroplating process.

Also shown in FIG. 3D, the structure of one embodiment of the anode structure 114 is shown and described below. In this illustrative embodiment, the anode structure 114 comprises a substrate 121, and a conductive layer 120. More specifically, the anode structure 114 may be constructed from a substrate 121 having a conductive layer 120 disposed directly onto the substrate 121. The conductive layer 120, which functions to receive the electrons emitted from the cathode, may be made of any suitable conductive material such as tantalum, gold, tungsten, molybdenum, copper, or any other like material. In addition, in some embodiments, the conductive layer 120 may be made from carbon-containing materials, silicides, or other appropriate materials. The substrate 121 may be made from any material having a suitable strength for holding the conductive layer 120 in a fixed position over the grid 107 and cathode 113. For example, the second substrate 121 may be made from any one of the substrate materials described above with reference to the base substrate 101, including silicon, glass, ceramic, etc.

Figure 4A:
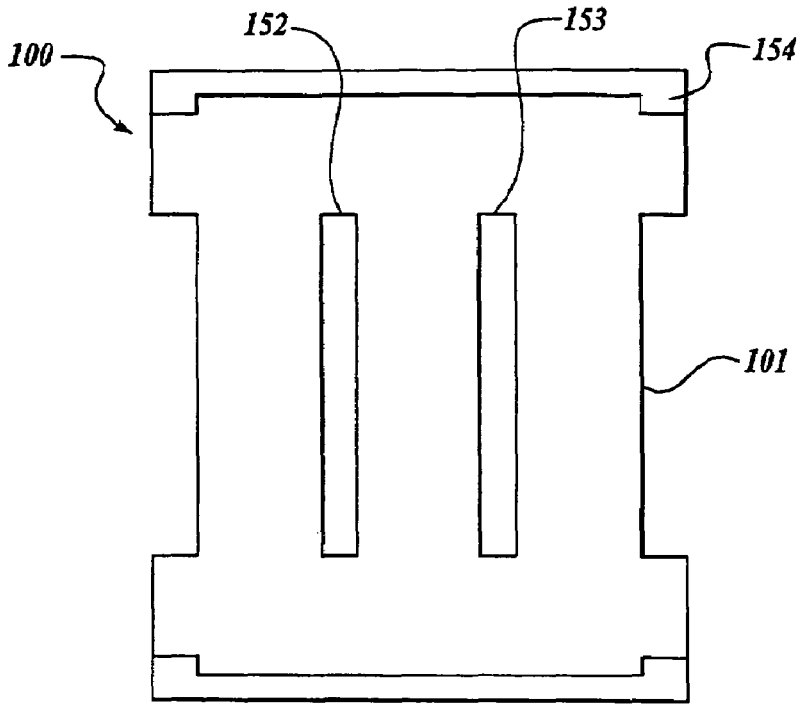
FIG. 4A is a top view of an etched substrate utilized in the construction of the device shown in FIG. 1.
Figure 4B:
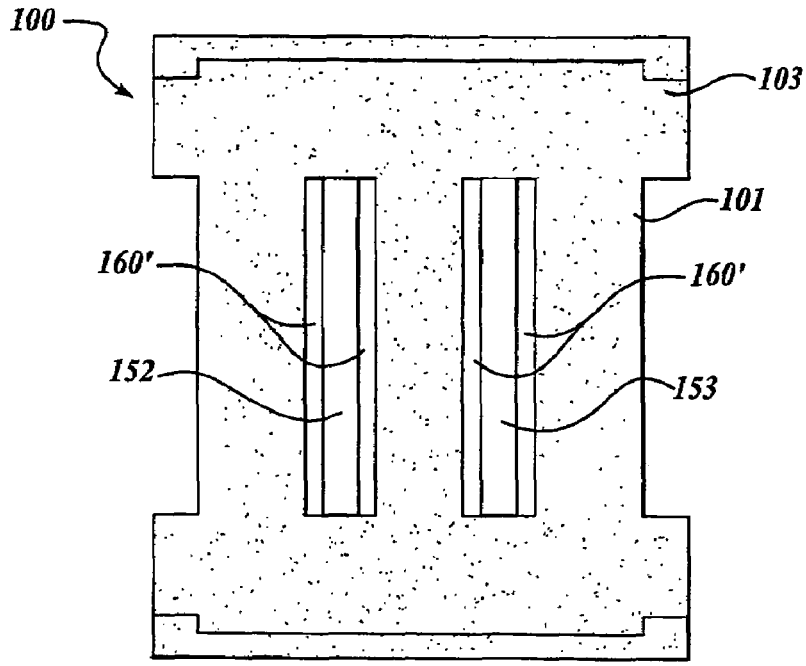
FIG. 4B illustrates a top view of the substrate illustrated in FIG. 4A having a plurality of cavities etched therein.
Figure 4C:
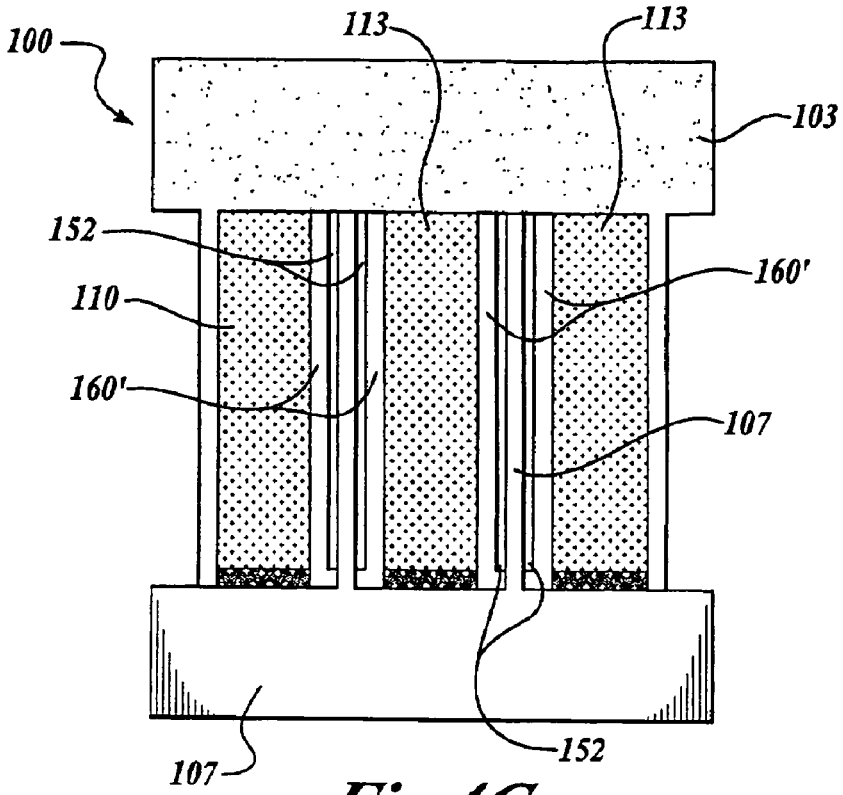
FIG. 4C is a top view of the substrate illustrated in FIG. 4A having a grid component applied thereon.
Figure 4D:
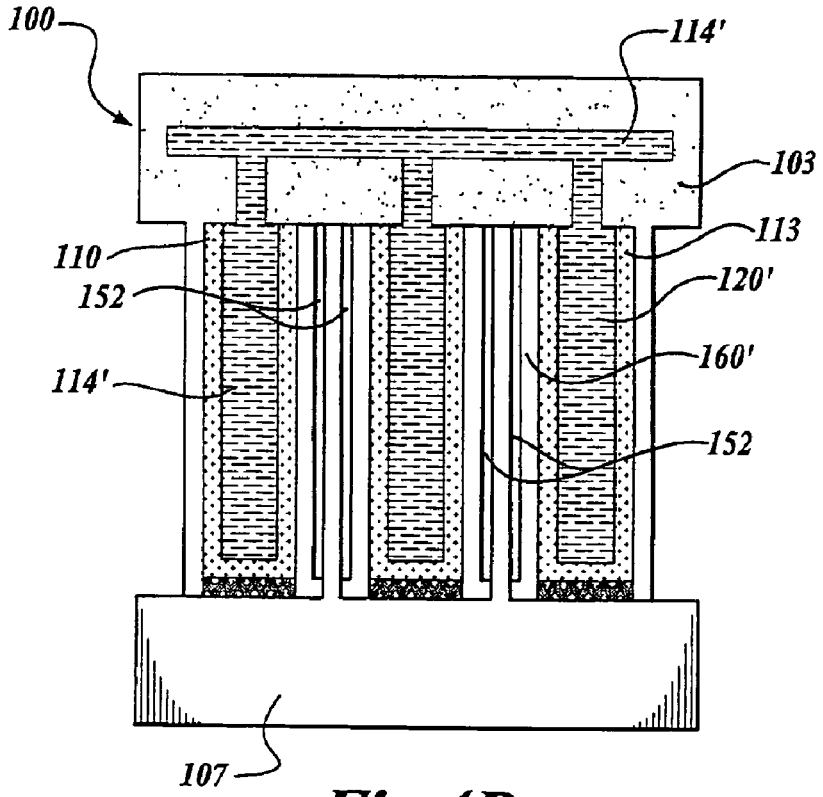
FIG. 4D is a top view of the substrate illustrated in FIG. 4A having an anode component.

In one embodiment, the anode structure may be in the form of a conductive layer shaped into elongated electrodes, such as those shown in FIG. 4D. As shown in FIG. 4D, the shaped anode structure 114' comprises a number of elongated electrodes that are sized to span over the length of the air bridge surface covered with the electron-emitting material 110. In one embodiment, each electrode is vertically positioned above the cathode of the device.

In other alternative embodiments, the grid and/or anode can be disposed and patterned on other intermediate or base layers, such as an insulating layer. In several examples, an intermediate or base layer supporting the grid and/or anode may be made from a ceramic material, glass, semiconductor, conductor, metal, and other like materials or combinations thereof. In these alternative embodiments, such intermediate or base layers may be made from any known additive or subtractive technique. Alternatively, the grid or anode may be formed or disposed onto a supporting layer by the use of any known fabrication process. For example, the grid or anode can be formed by electroplating, evaporation, metal sputtering, or any other like method. In addition, the grid or anode may be further shaped by a process involving a sacrificial layer or substrate, photolithography, patterning, etching, lift-off, chemical-mechanical polishing, and other such processes. The grid or anode may be composed of a single material, a single layer of material, multilayers of materials, alloys, compounds, or the like. For example the grid or anode may be made from materials such as tungsten, gold, nickel, molybdenum, silver, copper, or tantalum, or any other like material. In addition, the grid or anode may be made from carbon-containing materials, silicides, or the like.

Once the anode, referred to as conductive layer 120', and the second substrate 121 are combined, thereby forming the anode structure 114', the conductive layer 120 is positioned over the cathode 113 and grid 107. Although this illustrative embodiment involves an anode structure 114' that is vertically positioned over the cathode 113 and grid 107, the anode structure 114' can be in any position relative to the cathode 113 and grid 107 so long as the anode structure 114' is in a position such that it can receive electrons emitted by the cathode 113.

After the cathode 113, grid 107, and anode structure 114 have been formed and positioned, the anode structure 114 is affixed to the base substrate 101. In one embodiment, the anode structure 114 is affixed to a raised border, such as the supporting wall 154, formed on the periphery of the substrate 101. In this embodiment, the anode structure 114 is affixed to the supporting wall 154 (see FIG. 4A) in a manner that creates an enclosed environment around the cathode 113, grid 107, and conductive layer 120 of the anode 114. The anode structure 114 is preferably sealed to the base substrate 101, where the seal is of suitable strength for supporting a controlled environment in the enclosure. In one embodiment, the anode structure 114 is hermetically sealed to the base substrate 101 by the use of any suitable fusing or sealing process. As can be appreciated by one of ordinary skill in the art, any known prior art process may be used to affix the anode structure 114 to the base substrate 101 for creating a controlled environment around the device components. In addition, the anode structure 114 may be attached to the base substrate 101 by any other structure that is used in place of, or in conjunction with, the supporting wall 154. For instance, any material having sufficient strength for supporting a vacuum environment may be used to attach the anode structure 114 to the base substrate 101. In such an embodiment, for example, a semiconductor or glass material may be hermetically sealed between the anode structure 114 and base substrate 101.

In an alternative embodiment of the anode structure 114, as shown in FIG. 1, the anode structure 114 may include a conductive layer 120 that covers one continuous surface area above the cathode 113 and grid 107. Accordingly, the conductive layer 120 of the anode structure 114 may cover a continuous surface area having an outer boundary defined by the edge of the supporting wall 154.

To create the controlled environment, all gases, such as oxygen and other impurities, are drawn from the volume surrounding the cathode, anode, and grid before the anode structure 114 is sealed to the base substrate 101. Once the vacuum environment is created within the enclosed environment, the seal is created between the anode structure 114 and the base substrate 101. Although one illustrative embodiment of creating an enclosure is shown, the anode structure 114, second substrate 121, and the base substrate 101 may be configured in any shape or form so long as each component is sufficiently shaped and configured to support a controlled environment surrounding the device components.

In other embodiments, the controlled environment surrounding the anode structure 114, grid 107 and cathode 113 may be in other forms that allow electrons to communicate between each component of the triode 100. For example, the enclosed area internal to the supporting wall 154 and anode structure 114 may be filled with a gas such as hydrogen, helium, argon or mercury.

Referring now to FIGS. 4A-4D, the top view of various components of the triode 100 are shown. As described in more detail above and shown in FIG. 4A, one illustrative example of a triode 100 comprises a formed substrate 101 having a first support 152, second support 153, and a supporting wall 154. FIG. 4B illustrates a top view of the formed substrate 101 having slotted cavities 160' etched therein. In addition, FIGS. 4C and 4D respectively illustrate a top view of one embodiment of the grid 107 and anode structure 114'.

The illustrative example depicted in FIGS. 4A-4D shows one embodiment of a SSVD that comprises three formed cathodes positioned on each side of the supports 152 and 153. This illustrative embodiment shows that the components disclosed herein accommodate a SSVD design having an array of devices, such as an array of triodes, tetrodes or pentodes, or combinations thereof. Accordingly, additional cathodes and supports can be added to the structure of FIGS. 4A-4D in a configuration similar to the array of cathodes described below.

Referring now to FIG. 4A, various aspects of the formed substrate are shown and described. As shown in FIG. 4A, the first support 152 and second support 153 are each formed into a generally elongated ridge having a narrowed top surface for supporting additional device components. Also shown in FIG. 4A, the elongated ridges created by each support 152 and 153 are substantially parallel to one another. FIG. 4A also illustrates one orientation of the supporting wall 154. As shown, the supporting wall 154 is formed along the periphery of the substrate 101.

FIG. 4B illustrates a top view of one embodiment of the slotted cavities 160' and oxidation layer 103 of the triode 100. As described above, the oxidation layer 103 is applied over the horizontal and vertical surfaces of the form substrate 101. Accordingly, the oxidation layer 103 forms a uniform surface over the top portions of the first and second supports 152 and 153 and the top surface of the base of the substrate 101. As described above and as shown in FIG. 4B, each slotted cavity 160', in one embodiment, can be configured into an elongated rectangular groove. Each slotted cavity 160' is positioned such that the sides of the grooves are parallel to the sides of each support 152 and 153. As described above, each slotted cavity 160' forms an opening through the oxidation layer 103 that allows for the removal of the substrate material underneath the oxidation layer 103.

FIG. 4C illustrates a top view of one embodiment of the grid 107. In addition, FIG. 4C illustrates the orientation and shape of the electron-emitting material 110 disposed on the air bridge structure. As described above with reference to FIG. 3D, the grid 107 includes a conductive layer that is selectively disposed on the top of each support 152 and 153. As shown in FIG. 4C, the grid 107 is formed into a number of thin strips of a conductive material that are shaped and positioned to cover the top surfaces of each support 152 and 153. The elongated strips of conductive material that form the grid 107 extend over a substantial portion of or beyond each support 152 and 153. In the embodiment shown in FIG. 4C, the width of each elongated strip does not exceed the width of the respective support on which it rests. In other alternative embodiments, such as the grid 107 shown in FIGS. 1 and 3D, the width of each elongated strip of the grid 107 is equal to or greater than the width of the support on which it rests.

Also shown in FIG. 4C, the electrically conductive material that forms the grid 107 may extend from each support 152 and 153 to a portion of the substrate 101 (see FIGS. 4A-B) that allows for electrical communication with an external circuit. In this illustrative embodiment, the grid 107 covers a surface area that extends along at least one edge of the substrate 101, thereby forming an external contact surface.

Referring now to FIG. 4D, a top view of the triode 100 is shown and described below. As illustrated in FIG. 4D, the top view reveals one embodiment of the relative position and shape of the various layers that make up the anode 114', cathode 113 and grid 107. As can be appreciated by one of ordinary skill in the art, each layer is separated by an insulating layer and configured to allow an external electrical circuit to independently connect to each component 114', 113, and 107.

As shown in FIG. 4D, one embodiment of a formed anode structure 114' is shown. In this embodiment, the formed anode structure 114' is made of a shaped conductive layer 120' and a substrate (not shown). For illustrative purposes the top view of FIG. 4D only illustrates the conductive layer 120' of the formed anode structure 114'. As shown, the conductive layer 120' is formed into a number of elongated members that are each configured in a shape that may be substantially similar to the shape of the cathode 113. Each elongated member of the shaped conductive layer 120' is respectively vertically positioned over a cathode 113. In one embodiment, the conductive layer 120' is configured to extend over a substantial portion of the cathode 113. In this embodiment, the width of the formed anode structure 114' is equal to or less than the width of the cathode. In another embodiment, the width of the formed anode structure 114' may be greater than or equal to the width of the cathode.

In yet another embodiment of the anode structure 114', the conductive layer 120' may be configured into a single conductive layer that covers one continuous surface area over the grid 107 and cathode 113. As shown in FIG. 1, this embodiment may involve a conductive layer that is configured to extend to each supporting wall of the device, thereby creating one continuous conductive layer over the cathode 113 and anode 107. Although several illustrative embodiments of the anode 107 are described herein, as can be appreciated by one skilled in the art, the anode 107 may be formed into a large variation and a number of embodiments.

Figure 5A:
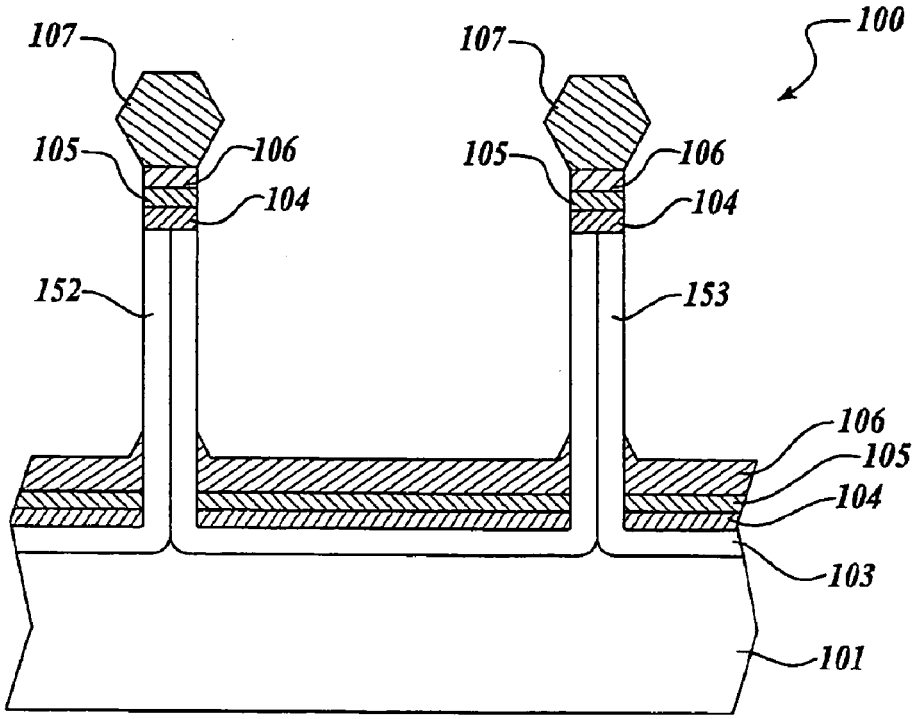
FIGS. 5A-5C illustrate several steps of another embodiment of a fabrication process for forming a device.
Figure 5B:
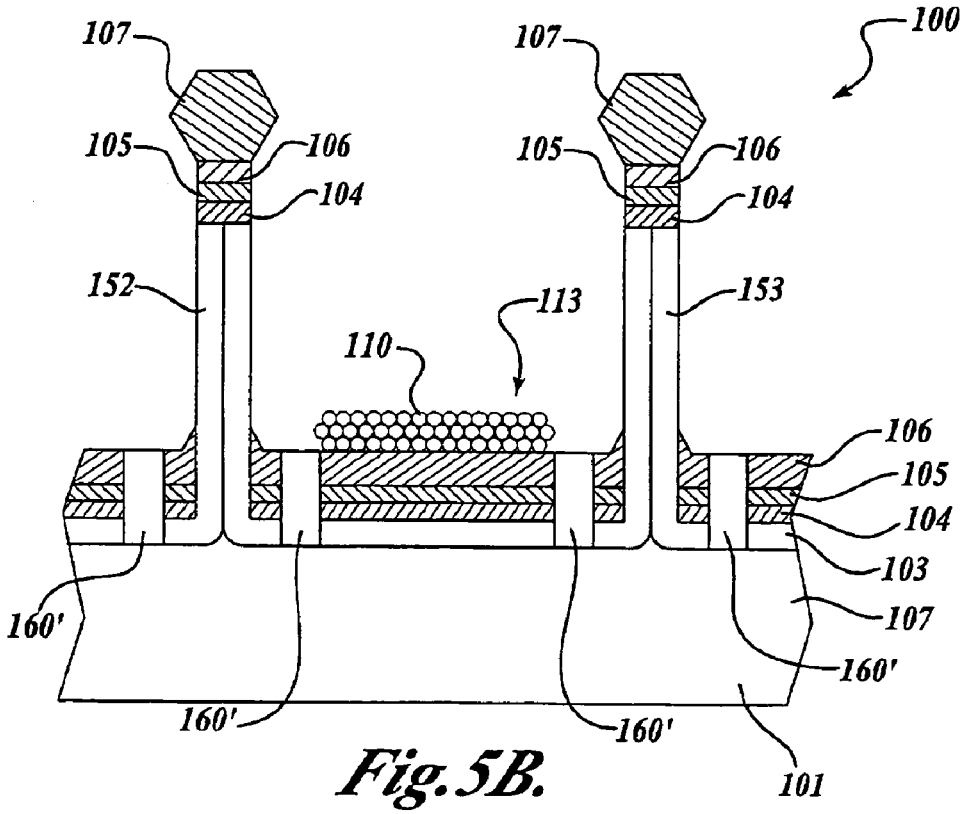
Figure 5C:
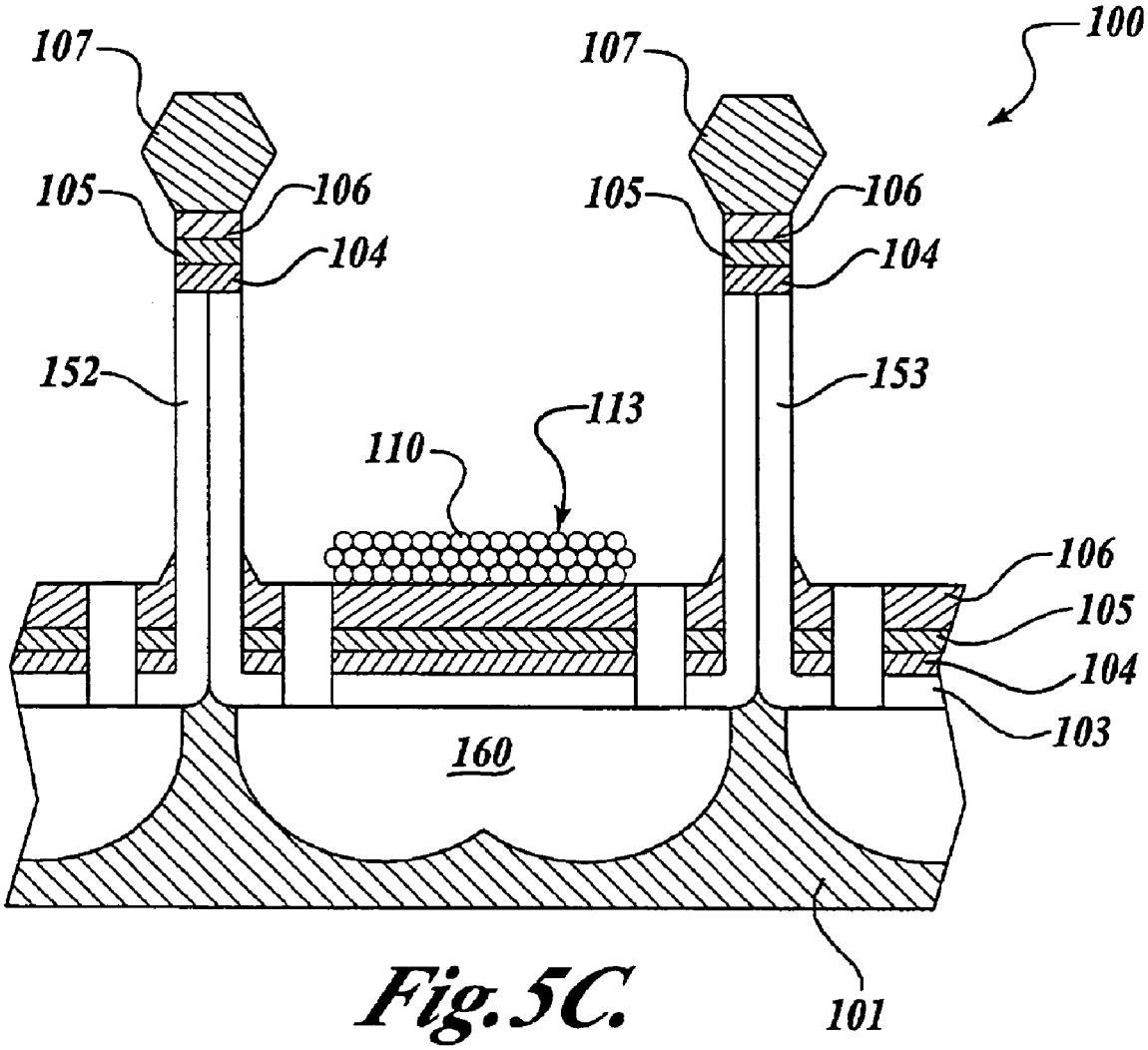

Referring now to FIGS. 5A-5C, another embodiment of a fabrication process for forming a triode 100 is shown and described below. In general, the triode 100 depicted in FIGS. 5A-5C includes the same device components as the triode 100 depicted in FIG. 1. In general, this embodiment of the fabrication process for producing the triode 100 utilizes a number of process steps as described above with reference to FIGS. 3A-3D. As described in more detail below, this embodiment of the fabrication process involves the formation of the insulation and conductive layers 103-106 on the substrate 101 before the cavity 160 is formed in the substrate 101. This embodiment allows the substrate 101 to support the components of the air bridge structure during the application of each layer 103-106 and 110 of the cathode 113.

As shown in FIGS. 5A-B this embodiment of the fabrication process starts by forming an oxidation layer 103 on the surface of the substrate 101 by the use of a process that is similar to the fabrication process described above with reference to FIGS. 3A-3D. Next, this embodiment of the fabrication process involves the application of the first conductive and second electrically insulating layer 104 and 105, respectively. The conductive first and second layers, 104 and 105, are respectively applied onto the oxidation layer 103 by the use of fabrication processes that are similar to the fabrication process described above. This embodiment of the fabrication process also involves the application of a second conductive layer 106, which is disposed on the second insulating layer 105. As described above, the insulating layer 105 can be formed onto the conductive layer by any known process, such as sputtering, electron beam evaporation, and wet oxidation. The electron-emitting material 110, grid 107 and slotted cavities 160' are formed by the use of any one of the above-described fabrication processes. The slotted cavities 160' of this embodiment may be formed in a shape and configuration similar to the slotted cavities 160' described above with reference to FIGS. 3C and 3D. In this embodiment, the slotted cavities 160' are etched through the plurality of layers 103-106.

After the formation of the slotted cavities 160', as shown in FIG. 5C, the substrate cavity 160 is formed under a portion of the oxidation layer 103 that is positioned between the first and second support 152 and 153. The substrate cavity 160 can be formed by any one of the above-described etching techniques, such as dry or wet etching. By the use of the fabrication process of FIGS. 5A-5C, the air bridge structure is properly formed during the application of the various layers 103-106 and 110 of the cathode 113.

Referring now to FIGS. 6A-6D, another embodiment of a fabrication process for forming a device 200 is shown and described below. In general, this embodiment depicted in FIGS. 6A-6D comprises a plurality of masking steps to form a plurality of stacked supports that form the grid 209 and cathode 212 of the device 200. As will be described in more detail below, this embodiment of the device 200 may be utilized in the construction of a cathode and grid that may be used to form a diode, triode, or any other higher order device.

Figure 6A:
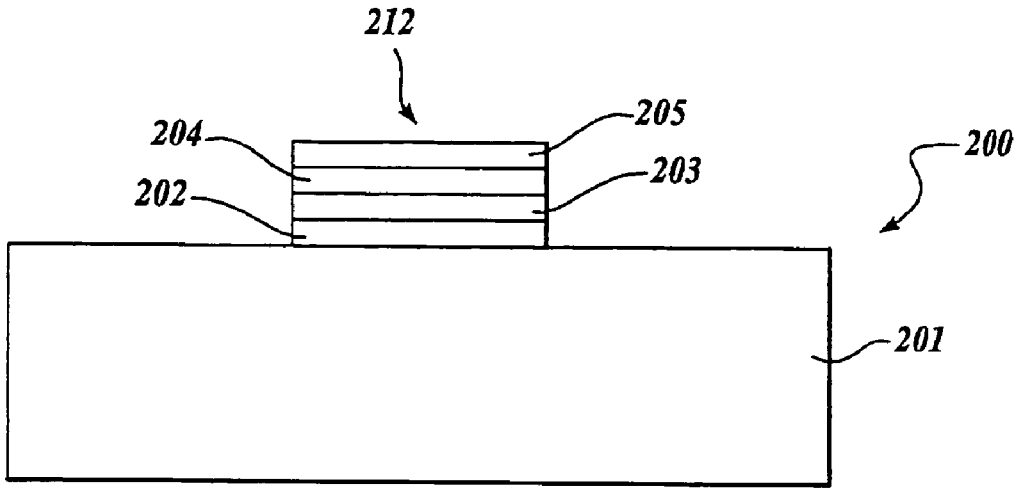
FIGS. 6A-6D illustrate several steps of yet another embodiment of a fabrication process forming a stacked structure of a cathode and grid of yet another device.

Referring now to FIG. 6A, this embodiment of the fabrication process begins with a base substrate 201. In one embodiment, the substrate 201 may be formed into any desired shape but is preferably shaped to have a substantially flat top surface. The substrate 201 may be made from any base material such as a single crystal, polycrystalline material, amorphous material, or any other appropriate substrate material depending on the application.

In the first part of the fabrication process, components 202-205 of the cathode 212 are disposed onto the substrate 201. In several embodiments of the fabrication process, the substrate 201 is first cleaned in accordance with standard substrate cleaning techniques. Next, one of the planar surfaces of the substrate 201 is then covered with a patterned spacing layer 202. The patterned spacing layer 202 can be made of any conventional masking material such as silicon nitride, silicon dioxide, or any appropriate polymer. In another embodiment, the patterned spacing layer 202 can be made from a composite layer of silicon nitride overlying a layer of silicon dioxide. The patterned spacing layer 202 can be configured to any desired thickness; however, in one embodiment the patterned spacing layer 202 is formed with a thickness of 0.1 micron to 1 millimeter.

Figure 6B:
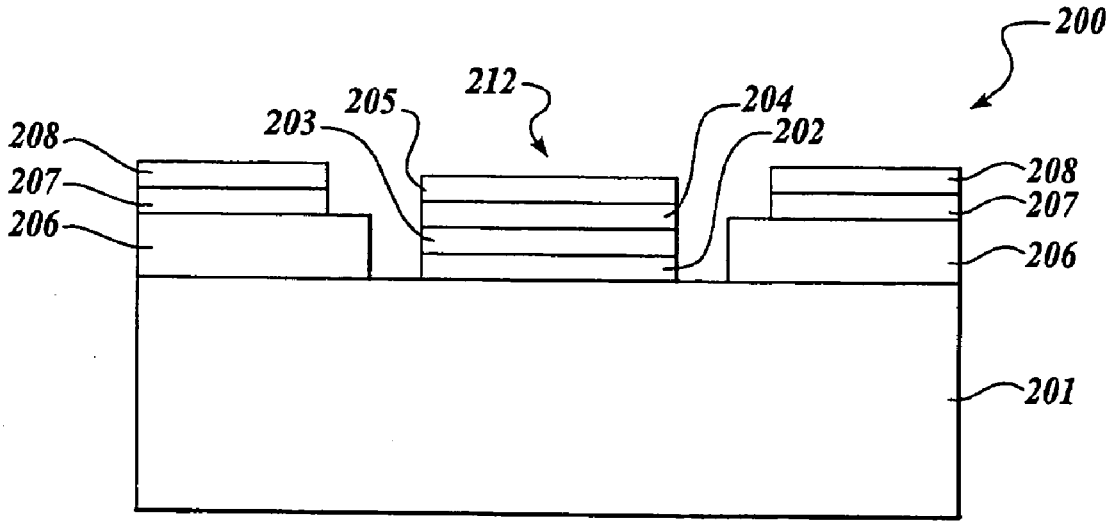

As shown in FIG. 6A, the patterned spacing layer 202 is shaped into a desired configuration to form the base of the cathode 212. With reference to FIGS. 6A-6B, one embodiment of the cathode 212 is formed into a generally elongated rectangular member having a sufficient length to form a suspended air bridge structure that extends over a cavity in the substrate 201. Any conventional or novel masking process may be employed in forming the patterned spacing layer 202 such as those described above with reference to FIGS. 3A-3D. In one embodiment, an etching process employing hydrofluoric (HF) acid can be used to properly shape the patterned spacing layer 202.

Subsequent to the processing of the patterned spacing layer 202, the surface of the patterned spacing layer 202 may then be exposed to a masking process for disposing a first conductive layer 203 on top of the patterned spacing layer 202. As shown in FIG. 6A, the first conductive layer 203 may be formed into a shape that is substantially similar to the shape of the patterned spacing layer 202. In one embodiment, this part of the process involves the application of a layer of chromium, and depending on the particular embodiment, the application of the chromium is followed by additional conductive layers such as tungsten. Although chromium and tungsten are utilized in this illustrative example, any other appropriate electrically conductive material, non-conductive material, transition metal, or combinations thereof may be used in this part of the fabrication process.

The process continues with the application of a second conductive layer 204. In one embodiment, this part of the process involves the application of a thin layer of tungsten that is directly applied or applied with a suitable intermediate layer on the first conductive layer 203. Although tungsten is utilized in this illustrative example, nickel or materials having like properties may be used in this part of the fabrication process. Similar to the first conductive layer 203, an electrically insulating layer 204 is preferably formed into a shape that is substantially similar to the shape of the patterned spacing layer 202. Next, a second conductive layer 205 is disposed onto the electrically insulating layer 204. In one embodiment, the second conductive layer 205 is a thin layer of chromium followed by a layer of tungsten. It should be appreciated and understood that each of the individual layers may consist of a number of sublayers of different materials, which preferably convey the same material properties.

The above-described shaped layers 202-205 may be formed by the use of any fabrication process or processes for shaping oxidation and metallic layers. In one embodiment, the shaped layers 202-205 are formed by the use of a photoresist material or any other appropriate material that can be shaped by a mask or molded or patterned. Alternatively, the shaped layers 202-205 that form the foundation of the cathode 212 may utilize other generally known fabrication processes, including those utilizing wet or dry etching techniques.

Referring now to FIG. 6B, a plurality of insulating and conductive layers 206-208 utilized in the construction of the grid support structure are shown. In this part of the process, an insulating layer 206 is applied onto the planar surface of the substrate 201 on opposite sides of the cathode foundation to form a raised surface for the grid. In one embodiment, the insulating layer 206 is formed into an elongated member that is positioned near the foundation of the cathode 212, where the elongated side of the insulating layer 206 is substantially parallel to the elongated side of the cathode foundation. In one specific embodiment, the insulating layer 206 may be formed in an elongated rectangular shape similar to the shape of the first and second supports 152 and 153 as shown in the top view of FIG. 4B. Also as illustrated in the top view of FIG. 4B, in certain embodiments, the distance between the foundation of the cathode 212 and insulating layer 206 should be sized to allow for the etching of the substrate surface between the foundation of the cathode 212 and insulating layer 206. The insulating layer may be applied to the substrate 201 by any known technique, including: CVD, PVD, anodic oxidation, spin-on-glass (SOG) techniques, or thermal or other growth techniques. In methods where the SOG is used, the SOG may be cured in a nitrogen-purged oven. Other known processes for producing the above-described structures are also within the scope of the present invention.

Returning now to FIG. 6B, this embodiment of the fabrication process also involves the application of third and fourth conductive layers 207 and 208. More specifically, the third and fourth conductive layers 207 and 208 are respectively formed on the top of the insulating layer 206. In one embodiment, the third and fourth conductive layers are each formed into an elongated member having a shape that is substantially similar to the insulating layer 206. In one embodiment, the third conductive layer 207 may be made from a number of materials, including chromium and/or other metals and elements. The fourth conductive layer 208 may be made of any conductive material such as nickel, tantalum, silver, molybdenum, gold, copper, tungsten, platinum, or any other like material. In addition, the conductive layer 208 may be made from carbon-containing materials, silicides, or other appropriate materials.

In one embodiment, the third and fourth conductive layers 207 and 208 each have a thickness between 1 nanometer and 1 mm. It should be understood and appreciated that layers less than 1 nanometer or greater than 1 mm may be employed in other embodiments. The third and fourth conductive layers 207 and 208 may be applied by any known fabrication processes for defining, shaping, and/or creating formed metallic layers. For instance, the third and fourth conductive layers 207 and 208 may be applied onto the insulating layer 206 by a sputtering technique. Once the third and fourth conductive layers 207 and 208 are disposed onto the insulating layer 206, the wafer may be exposed to an acetone bath, which employs ultrasonic techniques for agitation. It should be appreciated that some embodiments of the supports may only comprise one layer 207 or 208. In addition, it can be appreciated that other embodiments may comprise more than two distinct layers, such as the two layers referred to as 207 and 208. Thus, any single or multiple layered structure may be used to form the supports of the device 200, and such structures providing thermal and electrically insulative properties may be used.

Figure 6C:
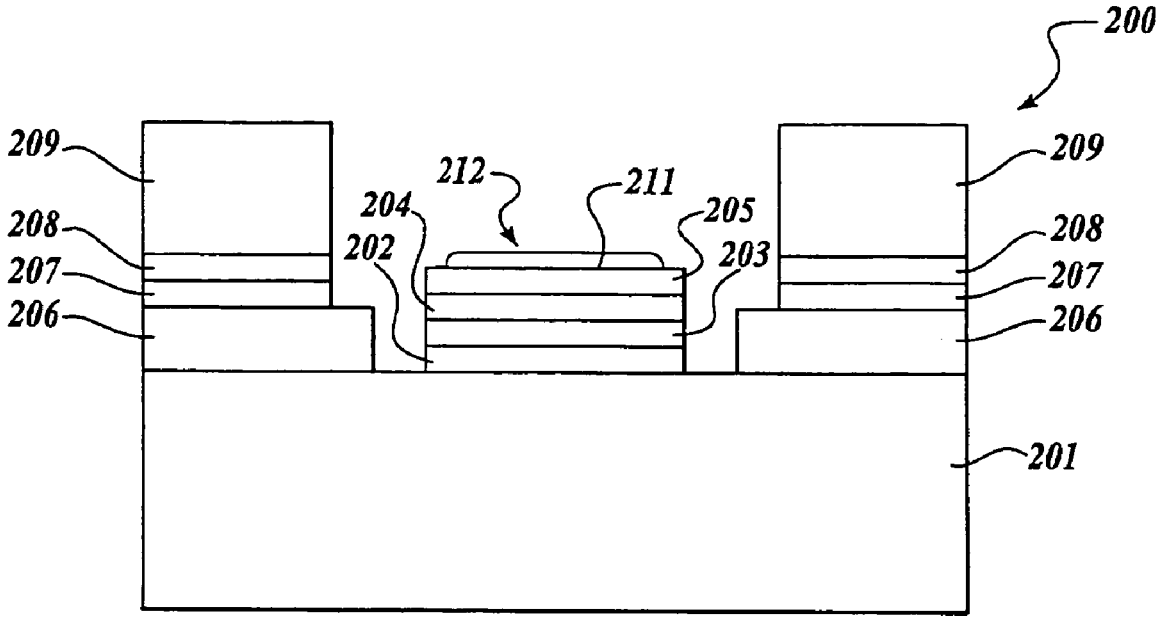

Following the application of the third and fourth conductive layers 207 and 208, as shown in FIG. 6C, a grid 209 is applied directly onto the fourth conductive layer 208. Similar to the grid 107 shown in the top view of FIG. 4D, the grid 209 of this embodiment may be formed into an elongated rectangular pattern, where one side of the elongated rectangle is substantially parallel to one side of the formed cathode. In one embodiment, the grid 209 is formed to have a thickness of less than one nanometer to a thickness of greater than one millimeter. In one specific embodiment, the grid 209 is configured to have a thickness between 1 and 20 microns. Similar to the embodiments described above, the grid 209 may be made from any conductive material. For example, the grid 209 may be made of nickel, tungsten, molybdenum, platinum, tantalum, titanium, or any other like material. In one embodiment, a photoresist known in the art as AZ4620 is used as the mold material for applying the grid 209. In one embodiment involving a nickel grid material, nickel electroplating is used to raise the height of the grid 209, which increases the gain of the device 200. In other embodiments, layers 207 and 208, or any other suitable component, may be utilized to raise the height of the grid 209.

In the construction of the cathode 212, an electron-emitting material 211 is applied directly onto the second conductive layer 205. As described above, with the embodiment shown in FIG. 3D, the electron-emitting material 211 may be made from any appropriate material or metal including a low work function material, such as a trioxide coating comprised of oxides of barium, strontium, and calcium. In alternative embodiments, the low work function material may be a BaSr bicarbonate or a material comprising barium, strontium and aluminum. Thoriated tungsten, scandate, and scandia may also be included in other embodiments of the low work function material. As described above, with reference to the cathode 113 depicted in FIG. 3D, the electron-emitting material 211 is uniformly applied to the surface of the second conductive layer 205 by the use of the above-described fabrication techniques.

Figure 6D:
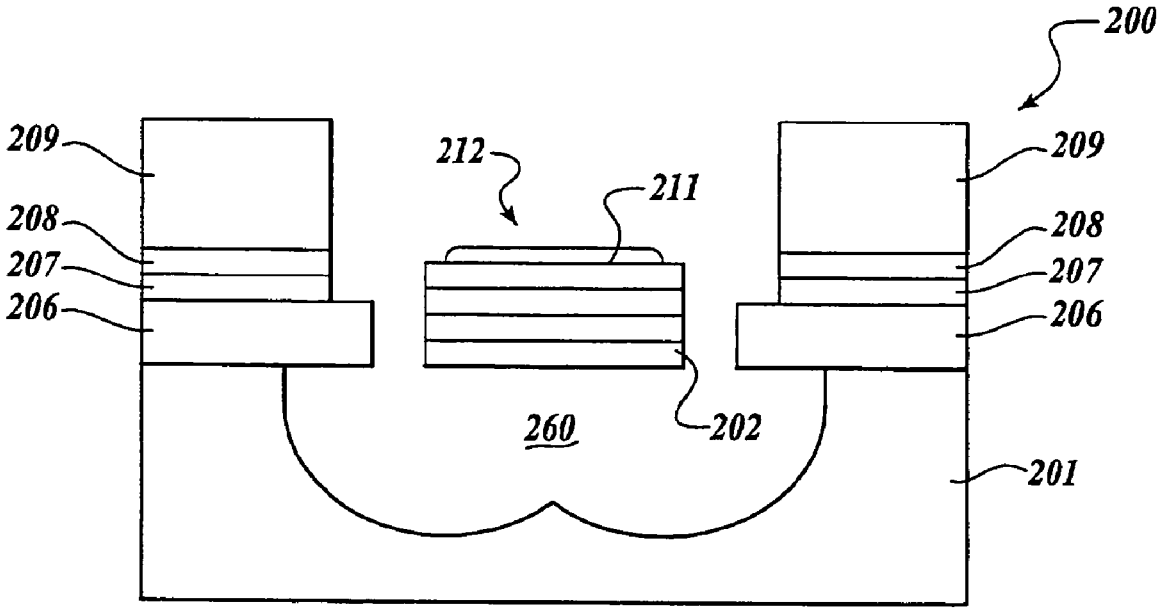

Referring now to FIG. 6D, the fabrication process of this embodiment also includes a step, or steps, that form a cavity 260 in the substrate 201. In one embodiment, the cavity 260 is formed in a shape and depth that is substantially similar to the shape and depth of the cavity 160 of the triode 100 shown in FIG. 1. The cavity 260 of this embodiment is formed underneath a substantial portion of the patterned spacing layer 202, thereby forming a cathode 212 having a suspended air bridge structure. The cavity 260 can be in any form or shape, but is preferably formed such that an air gap is created between a substantial portion or all of the cathode 212 and the substrate 201. As described above, the air gap created by the cavity 260 provides thermal isolation between the cathode 212 and substrate 201.

In this embodiment of the fabrication process, the cavity 260 is etched in the substrate 201 by the use of a fabrication process that is similar to the above-described fabrication process used to form the cavity 160 as shown in FIG. 1. For instance, the formation of the cavity 260 may employ the above-described dry and wet etching processes.

The illustrative example of the device 200 is not intended to be exhaustive or to limit the invention to the precise form disclosed herein. Although the device 200 shown in FIG. 6D is disclosed as one illustrative embodiment of the present invention, the device 200 may be made from a variety of different layers or combination of layers to form the cathode 212, grid support structure 206-208 and grid 209. For instance, as described above with reference to FIG. 3D, the cathode 212 can comprise a combination of conductive and insulating layers to employ direct or indirect cathode heating methods.

Now that several fabrication processes of various solid-state vacuum devices have been described in detail, several alternative embodiments of other solid-state vacuum devices will now be shown and described. More specifically, FIGS. 7-9 respectively illustrate other devices such as a tetrode, pentode and diode. As can be appreciated by one of ordinary skill in the art, the above-described fabrication processes provide unique techniques that allow for the construction of a diode, triode, tetrode, pentode, power tetrode, and any other higher order device.

Figure 7:
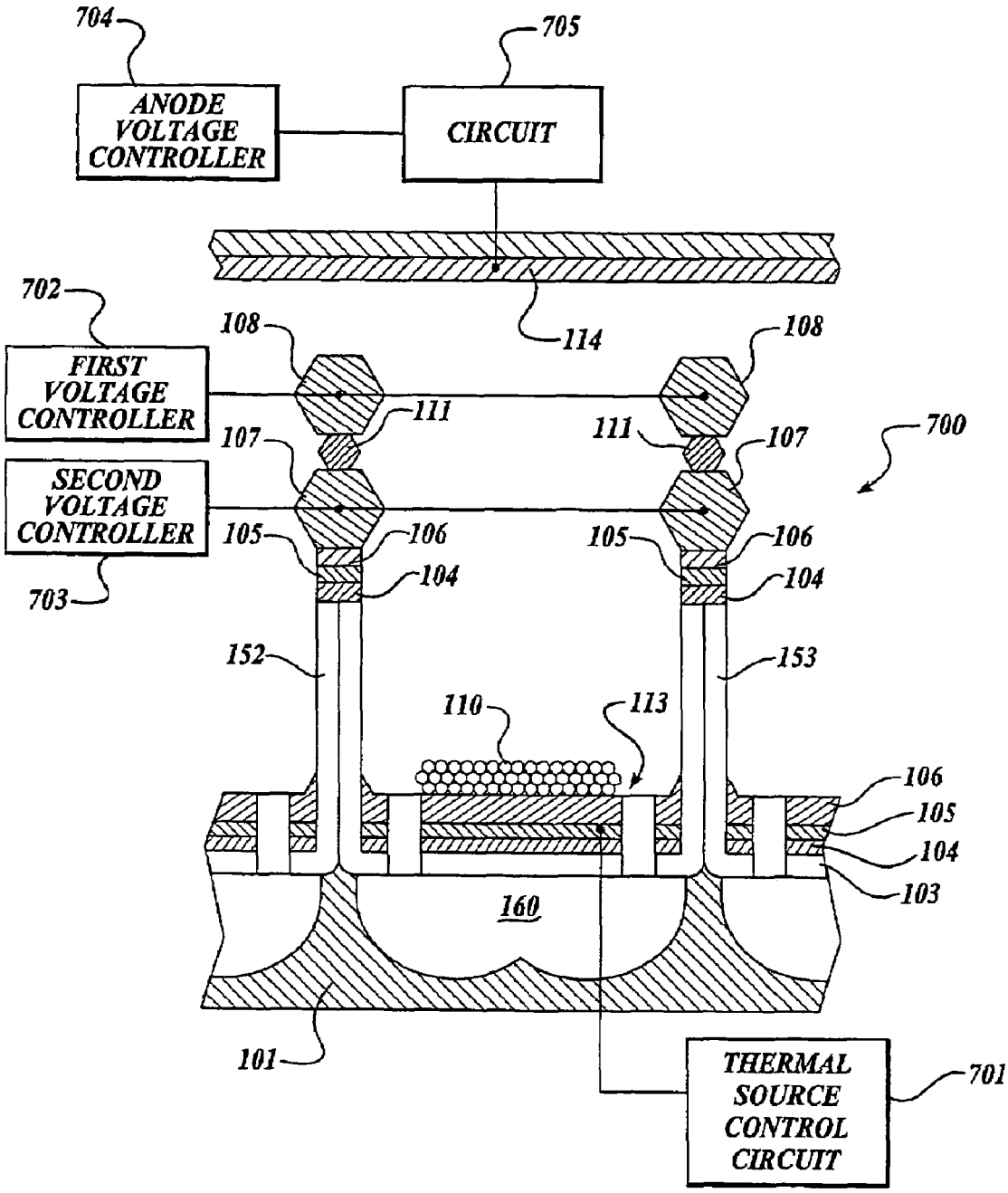
FIG. 7 is a front cross-section view of one embodiment of a device forming a tetrode.

Referring now to FIG. 7, another embodiment of a solid-state vacuum device forming a tetrode 700 is shown and described below. Generally described, the tetrode 700 comprises the general components of the triode 100 illustrated in FIGS. 3D and 5C. More specifically, the triode 700 comprises an anode 114, cathode 113, and a substrate 101 having a cavity 160 formed under the cathode 113. In addition, the tetrode 700 comprises an insulating layer 103, first conductive layer 104, second insulating layer 105, and second conductive layer 106 that are each configured in a manner similar to the triode 100 of FIG. 3D. As can be appreciated by one of ordinary skill in the art, each of these components can be formed and positioned by the use of any suitable fabrication process including any one or more of the fabrication processes described above.

In the fabrication process of the tetrode 700, an insulating layer 111 is applied to the top surface of the grid 107. The insulating layer 111 may be made from any material that has desired electrically insulating and resistive properties. The insulating layer 111 is preferably formed to a thickness that provides sufficient electrical insulation between the grid 107 and any other conductor applied on top of the insulating layer 111. With reference to FIG. 7, the insulating layer 111 is formed into an elongated member of sufficient size to cover the top surface of the grid 107.

Subsequent to the application of the insulating layer 111, the fabrication process of the tetrode 700 further comprises the application of a second grid 108. In this embodiment, the second grid 108 is made from a conductive material that is applied on the top surface of the insulating layer 111. This second grid 108 is formed on top of the insulating layer 111 by the use of any suitable fabrication process or processes including any one of the above-described fabrication processes associated with the application of the first grid 107. For instance, the second grid 108 may be formed by a seal-less or sealed layer electroplating process.

Also illustrated in FIG. 7, the various circuit components utilized in the operation of a solid-state vacuum device, such as the tetrode 700, are shown and described below. As shown in FIG. 7, a thermal source control circuit 701 is electrically connected to the conductive layer 104, also referred to as the thermal source 104. The thermal source control circuit 701 supplies a voltage to the conductive layer 104 causing the conductive layer 104 and indirectly the electron-emitting material 110 to heat. Once brought to a sufficient temperature, the electron-emitting material 110 emits electrons, which are ultimately received by the anode 114. In another embodiment used for directly heated cathodes, layers 105 and 106 may be absent. In other embodiments, layers 103, 105, and 106 may be absent.

Also shown in FIG. 7, an anode voltage controller 704 is electrically connected to the anode 114 for providing the anode 114 with a positive voltage to attract the electrons emitted from the electron-emitting material 110. As described above, in response to receiving electrons, the anode 114 produces an electrical current that can be utilized by a circuit 705. A first voltage controller 702 is connected to one grid layer 108 and a second voltage controller 703 is electrically connected to the other grid layer 107. Similar to a control circuit of a traditional tetrode formed in a vacuum tube, the first and second voltage controllers 702 and 703 provide a varied voltage signal to the grid layers 107 and 108 to control the flow of electrons received by the anode 114. In other embodiments, one voltage controller, such as the second voltage controller 703, may be coupled to a ground source. Accordingly, the amount of electrons received by the anode 114 effectively controls the current produced for the circuit.

Although this illustrative embodiment illustrates a tetrode having two independent voltage controllers for each grid, other embodiments having one or more control circuits can be used to control any number of grid layers of the solid-state vacuum devices disclosed herein. As can be appreciated by one of ordinary skill in the art, the above-described circuit configuration may be applied to other circuits such as a diode, triode, or pentode. For instance, in the application of the triode 100, one alternative embodiment of the control circuit may be substantially similar to the configuration shown in FIG. 7; however, this alternative embodiment of the control circuit typically only includes one voltage controller attached to the grid 107.

As described above, other higher order devices can be implemented by the use of the fabrication methods described herein. Hence, alternative embodiments of the fabrication processes are modified to form additional grid layers to the above-described device embodiments, thus yielding other device configurations having an increased power capacity. For example, FIG. 8 illustrates one embodiment of a pentode 800 that is made by adding a grid layer 109 to the tetrode embodiment of FIG. 7.

Figure 8:
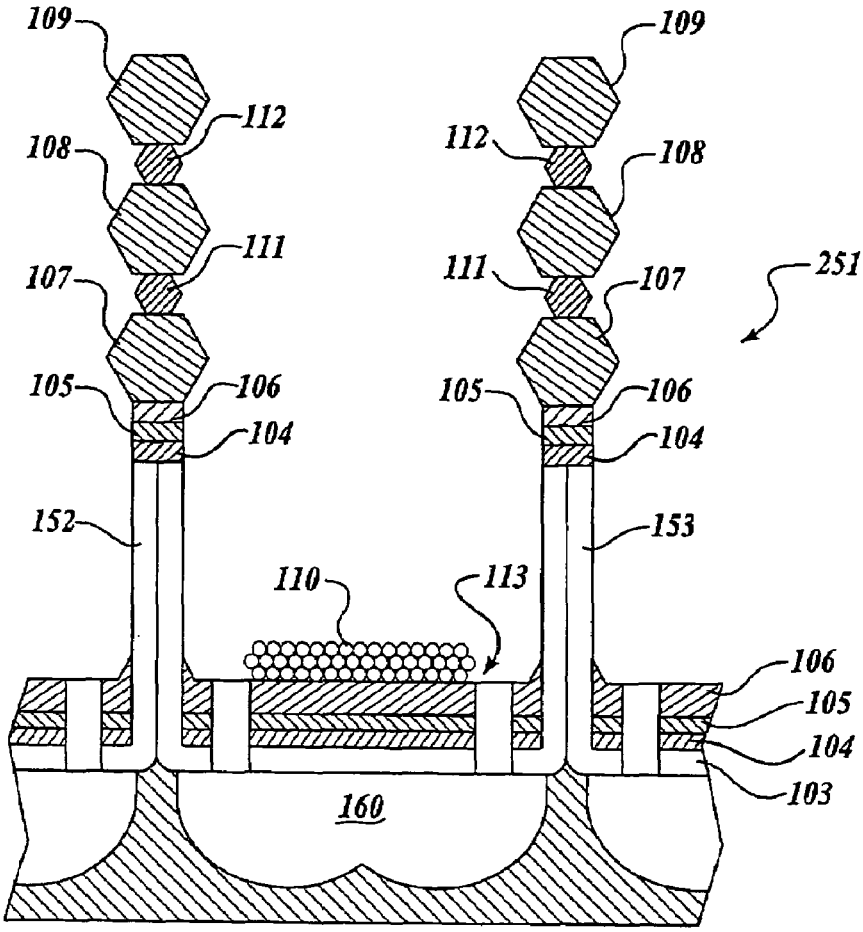
FIG. 8 is a front cross-section view of one embodiment of a device forming a pentode.

In the illustrative embodiment shown in FIG. 8, the pentode 800 comprises the general components of the tetrode 700 illustrated in FIG. 7. More specifically, the pentode 800 comprises an anode (not shown), cathode 113, and a substrate 101 having a cavity 160 formed under the cathode 113. In addition, the pentode 800 comprises an insulation layer 103, first conductive layer 104, second insulation layer 105, and a second conductive layer 106 that are each configured in a manner similar to the tetrode 700. As can be appreciated by one of ordinary skill in the art, each of these components can be formed and positioned by the use of any one of the fabrication processes described above.

In the fabrication process of the pentode 800, a second insulating layer 112 is applied to the top surface of the second grid 108. The second insulating layer 112 may be made from any material that has electrically resistive properties. The second insulating layer 112 is preferably formed to a thickness that provides sufficient electrical insulation between the second grid 108 and any other conductor applied on top of the second insulating layer 112. With reference to FIG. 8, the second insulating layer 112 is formed into an elongated member of sufficient size to cover the appropriate part of the top surface of second grid 108. The second insulating layer 112 is formed on top of the second grid 108 by the use of any one of the above-described fabrication processes describing the application of the insulating layer 111 on top pf the first grid 107.

Subsequent to the application of the second insulating layer 112, the fabrication process of the pentode 800 further comprises the application of a third grid 109. In this embodiment, the third grid 109 is made from a conductive layer that is applied on the top surface of the second insulating layer 112. The third grid 109 is formed on top of the second insulating layer 112 by the use of any one of the above-described fabrication processes describing the application of the first grid 107. For instance, an electroplating process may form the third grid 109.

Figure 9:
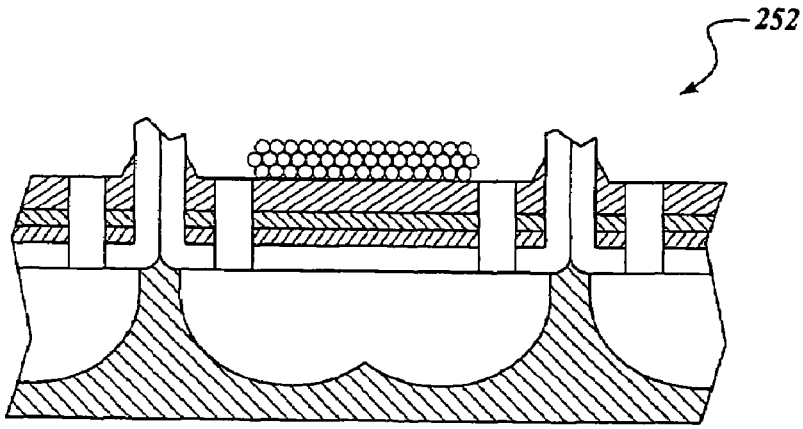
FIG. 9 is a front cross-section view of one embodiment of a device forming a diode.

Referring now to FIG. 9, another illustrative embodiment of a solid-state vacuum device forming a diode 900 is shown and described below. In general, the diode 900 comprises the general components of the triode 100 illustrated in FIGS. 3D and 5C. More specifically, the diode 900 comprises a cathode 113, an anode positioned above the cathode 113 (not shown), and a substrate 101 having a cavity 160 formed under the cathode 113. In addition, the diode 900 comprises an insulation layer such as an oxidation layer 103, first conductive layer 104, second insulation layer 105, and an second conductive layer 106 that are each configured in a manner similar to the triode 100 of FIG. 3D. As can be appreciated by one of ordinary skill in the art, each of the diode 900 components can be formed and positioned by the use of any one of the fabrication processes described above.

As shown in FIG. 9 and in view of the fabrication process shown in FIGS. 3A-3D, the fabrication of the diode 900 does not require the steps of forming the grid 107. Alternatively, the fabrication of the diode 900 utilizes the fabrication process of FIGS. 3A-3D and further comprises additional fabrication steps to remove the grid layer 107. Accordingly, a diode 900 having a cathode 113 and anode (not shown) suspended above the cathode 113 may be formed by any of the above described fabrication processes.

Figure 10:
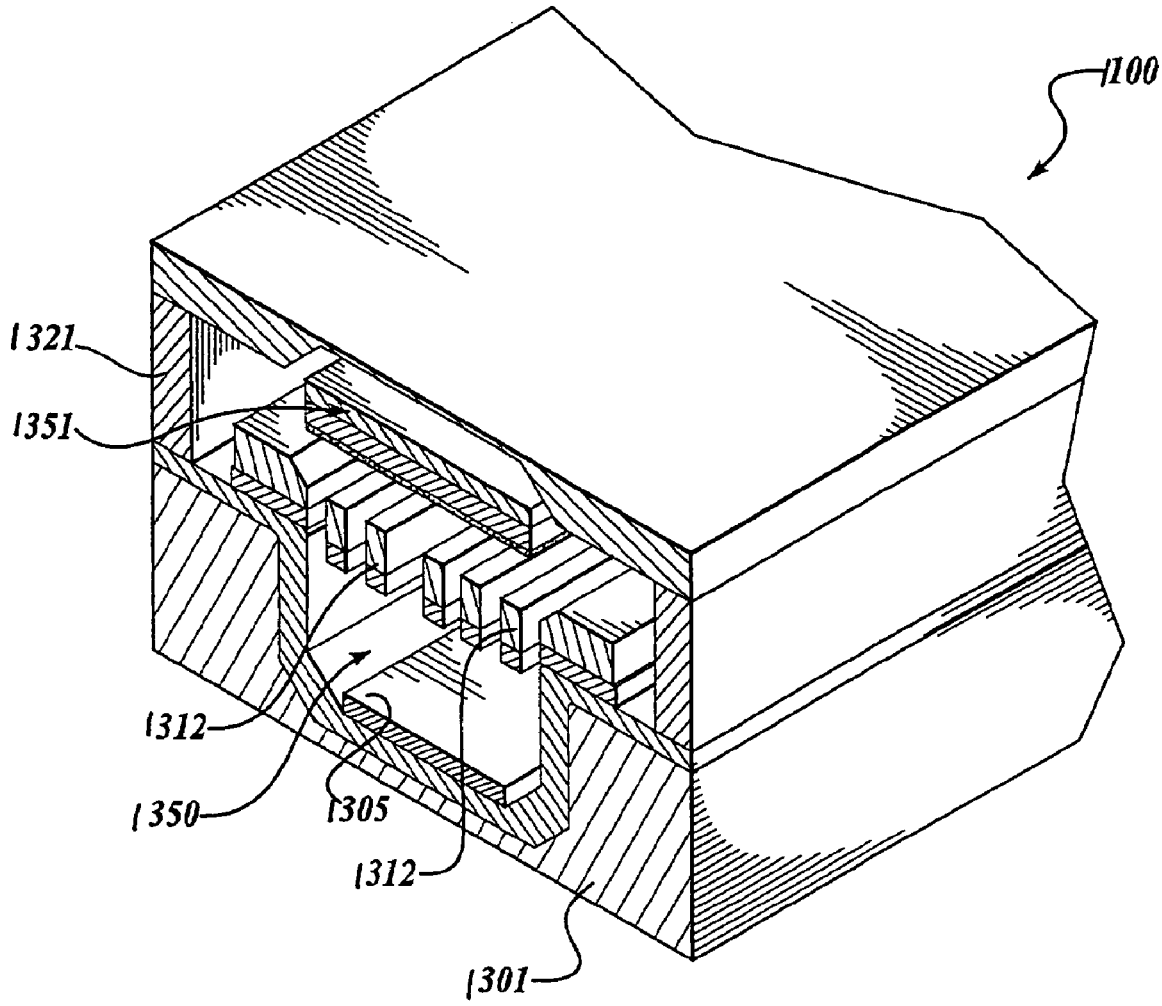
FIG. 10 is a top front cross-sectional perspective view of one embodiment of a solid state vacuum device in accordance with the present invention.

Referring now to FIG. 10, the basic elements of one embodiment of a triode solid state vacuum device 1100 (hereinafter referred to as the triode 1100) are shown. Generally described, the triode 1100 comprises a substrate 1301 having a cavity 1350 formed in the substrate 1301. The cavity 1350 of this embodiment is a void with an upper opening and a continuous wall formed by the substrate 1301 to define the boundaries of the void. The triode 1100 further comprises an anode 1305 positioned in the cavity of the substrate 1301, a cathode 1351 suspended over the cavity of the substrate 1301, and a grid 1312 positioned between the cathode 1351 and anode 1305. In addition, the triode 1100 comprises a sealed enclosure for creating a controlled environment in the area surrounding the grid 1312, cathode 1351, and anode 1305. The controlled environment allows charged carriers, such as electrons, to move between the cathode 1351, grid 1312, and anode 1305.

In the operation of the triode 1100, the cathode 1351, in one embodiment, is heated by a circuit that causes the cathode 1351 to emit charged carriers, such as electrons. Other possible electron emission mechanisms include photo-induced emission, electron injection, negative affinity, etc. Such alternate embodiments can be used separately or in conjunction with the thermionic emission. In one set of embodiments, the cathode is heated by a circuit that causes the cathode to emit electrons; this configuration is referred to as an indirectly heated cathode. In another configuration which is referred to as a directly heated cathode, the heater circuit provides energy/power to a structure that is directly part of and in electrical contact with the cathode and it emits electrons when it is heated. The emitted electrons pass through the grid 1312 and are received by the anode 1305. In response to receiving the electrons from the cathode 1351, the anode 1305 produces a current. The magnitude of the flow of electrons through the grid 1312 is controlled by a circuit that supplies a voltage or voltage waveform to the grid 1312. Accordingly, the voltage applied to the grid 1312 controls the electrical current produced by the anode 1305.

Figure 11A:
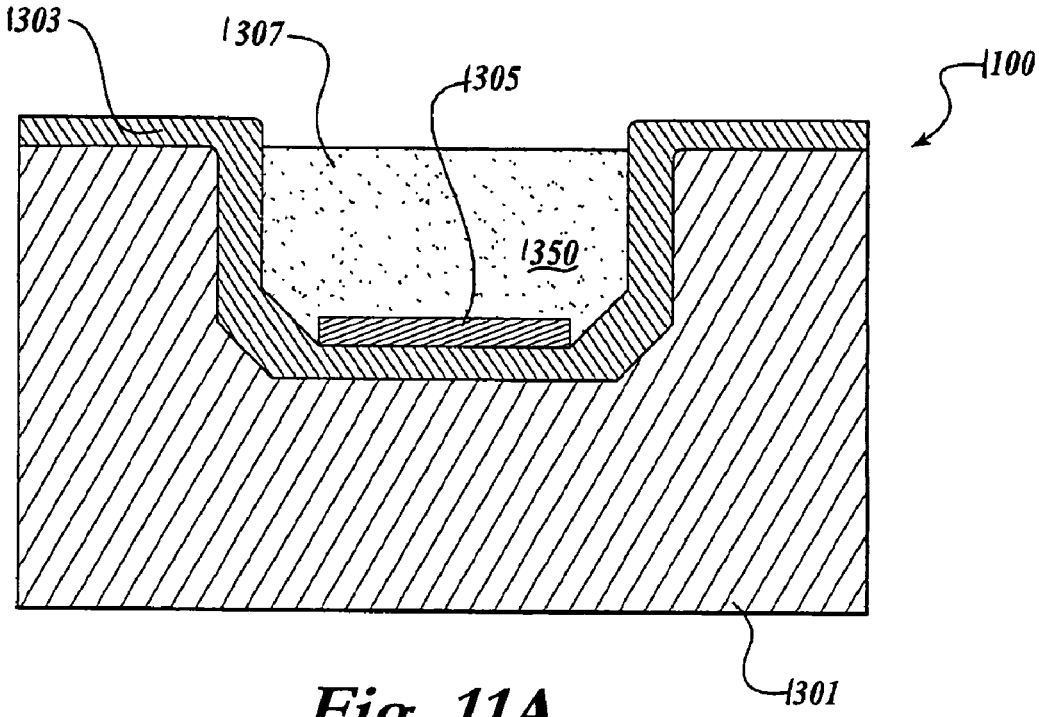
FIGS. 11A-E illustrate several steps employed in one embodiment of a fabrication process for forming a triode having an anode positioned in a substrate cavity.

Referring now to FIGS. 11A-E, one embodiment of a fabrication process forming a triode 1100 (FIG. 10) is shown and described. FIG. 11A is a side, cross-sectional view of the various components utilized in the fabrication process. As described below, the triode 1100 and all other solid state vacuum devices described are constructed by the use of solid state semiconductor fabrication techniques, such as thin film disposition, sputtering, etc. Accordingly, sub-micron, micron, and larger than micron scale dimensions may be achieved in the construction of each embodiment. In one aspect of the present invention, the smaller scale dimensions and various forms of each embodiment provide various improvements over conventional vacuum tube devices. For instance, the embodiments of the present invention enhance device transconductance (current per applied voltage), bandwidth and frequency performance of the devices. These benefits are made possible because the smaller dimensions allow the implementation of optimal grid design, i.e., smaller necessary grid spacing and grid to cathode distance that were not possible in conventional vacuum tube devices.

In one embodiment, the triode 1100 may be constructed on a substrate 1301, which may be made of a single crystal, polycrystalline material, amorphous material, any other semiconductor or any other appropriate substrate depending on application. For instance, the substrate 1301 may be made of polycrystalline silicon, amorphous silicon, silicon, gallium arsenide semiconductor substrates, glass, ceramic, metals, metal oxides, etc.

Figure 12A:
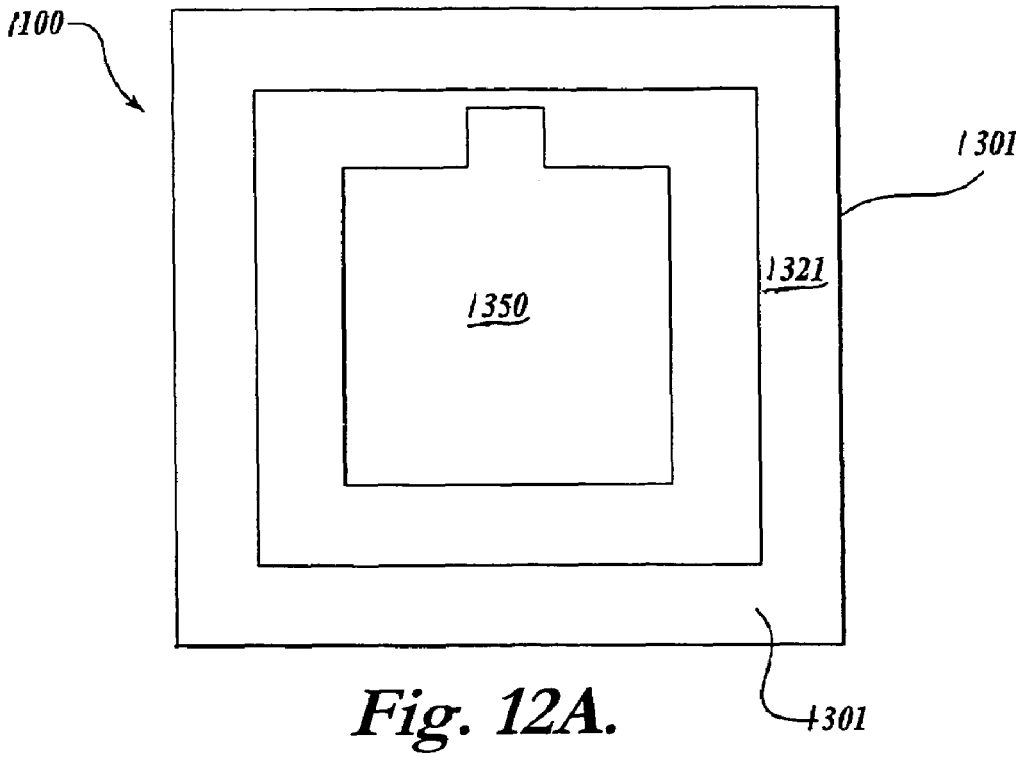
FIG. 12A is a top view of a substrate utilized in the construction of the embodiment of the solid state vacuum device depicted in FIG. 11E.

As shown in FIG. 11A, a cavity 1350 is formed in the top surface of the substrate 1301. In one embodiment, the cavity 1350 is etched to a depth between 150-200 microns. Although this illustrative embodiment utilizes these dimensions of the cavity 1350, the scope of the present invention also includes any cavity in the substrate 1301 having a depth greater than or less than the dimensions disclosed herein. In other embodiments, referred to as the through-hole embodiment, the triode 1100 may include a cavity 1350 that extends all the way through the substrate 1301. In this embodiment, the substrates of choice are usually an insulating type such as ceramic, glasses, etc. In one embodiment, the cavity 1350 may be in a square configuration as shown in FIG. 12A. In the implementation of the solid state vacuum devices described herein, the cavity 1350 may be in any shape or form other than a square or rectangle configuration. For instance, the cavity 1350 may be in the form of a triangle, trapezoid, circle, oval, etc. In other embodiments, the cavity 1350 may be a cylindrical shaped cavity formed in the top surface of the substrate 1301. In addition, no specific aspect ratio is required in the configuration of the cavity 1350. The cavity 1350 may be etched into the substrate 1301 by a number of known fabrication processes, such as a wet etch, dry etch, or any other like method. As known to one of ordinary skill in the art, a patterned mask layer and an effective etchant, e.g., sulfuric acid ($H_2SO_4$), or potassium hydroxide (KOH) may be used to create the cavity 1350. Methods employed to make the through-hole embodiment, which involves an insulating substrate such as ceramic, glass, etc., include etching, punching, preformed materials, drilling, milling, microdrilling, micromilling, laser techniques including laser ablation and other laser removal and/or deposition techniques.

As shown in FIG. 11A, the triode 1100 further comprises an oxidation layer 1303 deposited on the top surface of the substrate 1301. Also shown, the oxidation layer 1303 is also applied such that it covers the surface of the cavity 1350. The oxidation layer 1303 may be made of any insulating material such as silicon dioxide ($SiO_2$) or the like. The oxidation layer 1303 may be applied to the substrate 1301 by the use of any generally known fabrication method such as wet oxidation, sputtering evaporation, or any other like method. In one embodiment, the oxidation layer 1303 may be applied on the substrate 1301 at a thickness of approximately two microns. Although this illustrative embodiment comprises an oxidation layer having a thickness of two microns, any thickness and/or dimension of the oxidation layer may be used in the construction of the triode 1100.

Also shown in FIG. 11A, the triode 1100 further comprises an anode 1305 that is disposed on the oxidation layer 1303 and positioned in the cavity 1350. In one embodiment, the anode 1305 is configured to have a thickness between one micron and one millimeter. Although these dimensions for the anode 1305 thickness are presented for this illustrative example, any thickness and/or dimension may be used in the construction of the anode 1305. The anode 1305 may be constructed of any conductive material such as tantalum, gold, tungsten, molybdenum, copper, or the like.

The anode 1305 may be positioned in any orientation relative to the oxidation layer 1303 and the substrate 1301. For instance, in one embodiment, the anode 1305 may be configured to extend from the bottom surface of the cavity 1350 to the bottom surface of the substrate 1301. In this embodiment, the substrate 1301 may be made from any material, but preferably made from a glass-based material.

Any known fabrication process of disposing a conductive layer may be used to form the anode 1305. In one embodiment, the formation of the anode 1305 can be achieved by many ways including electroplating evaporation, metal sputtering, etc. In the through-hole embodiment, various bonding techniques are particularly applicable to secure a conductive layer on the bottom surface of the insulting substrate 1301. In addition, the anode 1305 may be further shaped by a process involving a chemical-mechanical polishing.

After the anode 1305 has been formed, a filling 1307 is placed in the cavity 1350. The filling 1307 may be made from any material that sufficiently fills the cavity 1350 to support the application of an etched conductive layer on top surface of the filling 1307. In one embodiment, the filling 1307 is configured to form a substantially flat, uniform surface at the opening of the cavity 1350. In alternative embodiments, the top surface of the filling 1307 may be configured to any other height relative to the bottom of the cavity 1350. As described in more detail below, the height of the top surface of the filling 1307 determines the height of the etched conductive layer (the grid) formed on the filling 1307.

In one embodiment, the filling 1307 may be a thick coat of polyimide disposed in the cavity 1350. Although polyimide is used as the filling 1307 in this illustrative embodiment, any filling material may be utilized in this step of the fabrication process. However, it is preferred to utilize a material that may be easily removed from the substrate 1301 without damaging the oxidation layer 1303 and anode 1305.

Figure 11B:
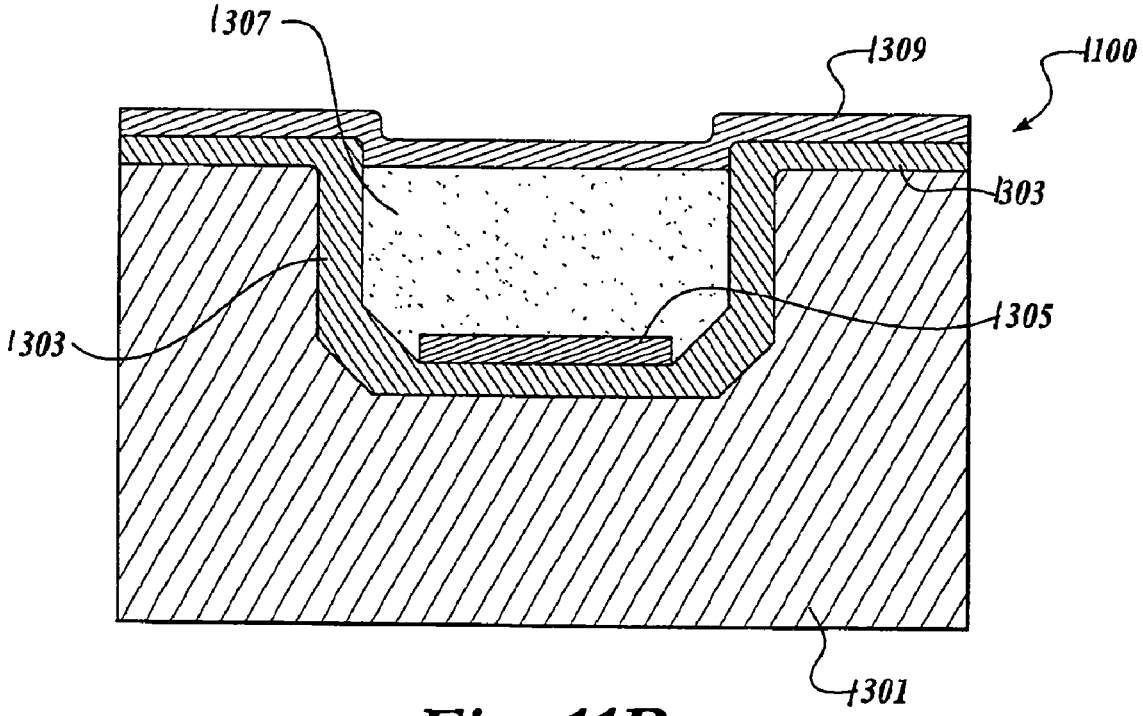

Referring now to FIG. 11B, the fabrication process continues with the application of a conductive layer 1309. In one embodiment, the conductive layer 1309 is applied on the top surface of the filling 1307 at a thickness in the range of one micron to one millimeter. Although this illustrative embodiment utilizes a conductive layer thickness of one micron to one millimeter, any other thickness greater or less than this range may be applied in this step. The conductive layer 1309 may be made of any conductive material such as gold, tantalum, tungsten, nickel or the like. As shown in FIG. 11B, the conductive layer 1309 may be configured to cover the entire top surface of the device, thereby creating a conductive layer on the top surface of the filling 1301 and a portion of the oxidation layer 1303 covering the top surface of the substrate 1301. The conductive layer 1309 may be disposed over the filling 1307 and oxidation layer 1303 by electroplating the selected conductive material directly on the filling 1307 and the oxidation layer 1303.

Figure 11C:
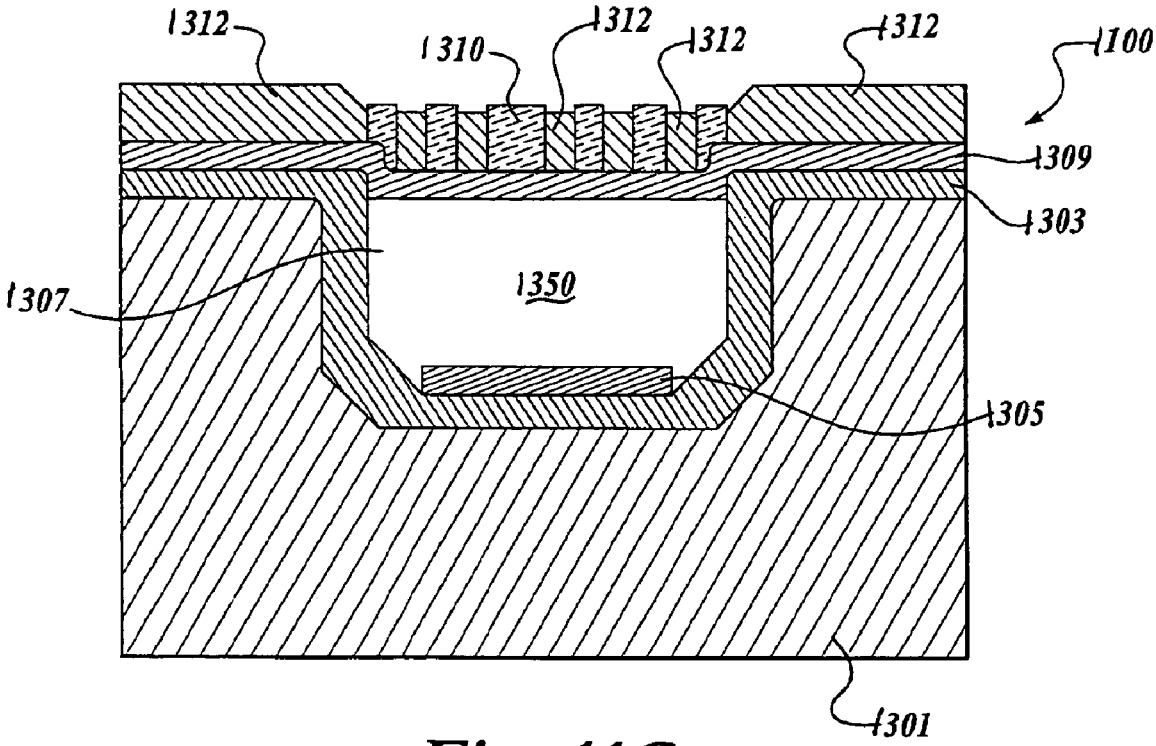

Referring now to FIG. 11C, the fabrication process then continues to a step where the grid 1312 of the triode 1100 is formed. As described in more detail below with reference to FIG. 12C, one embodiment of the triode 1100 comprises a grid 1312 that is configured from a thin conductive layer having a plurality of apertures therethrough. In another embodiment, the grid 1312 may be configured in a plurality of straight bars as shown in FIG. 10.

Figure 11D:
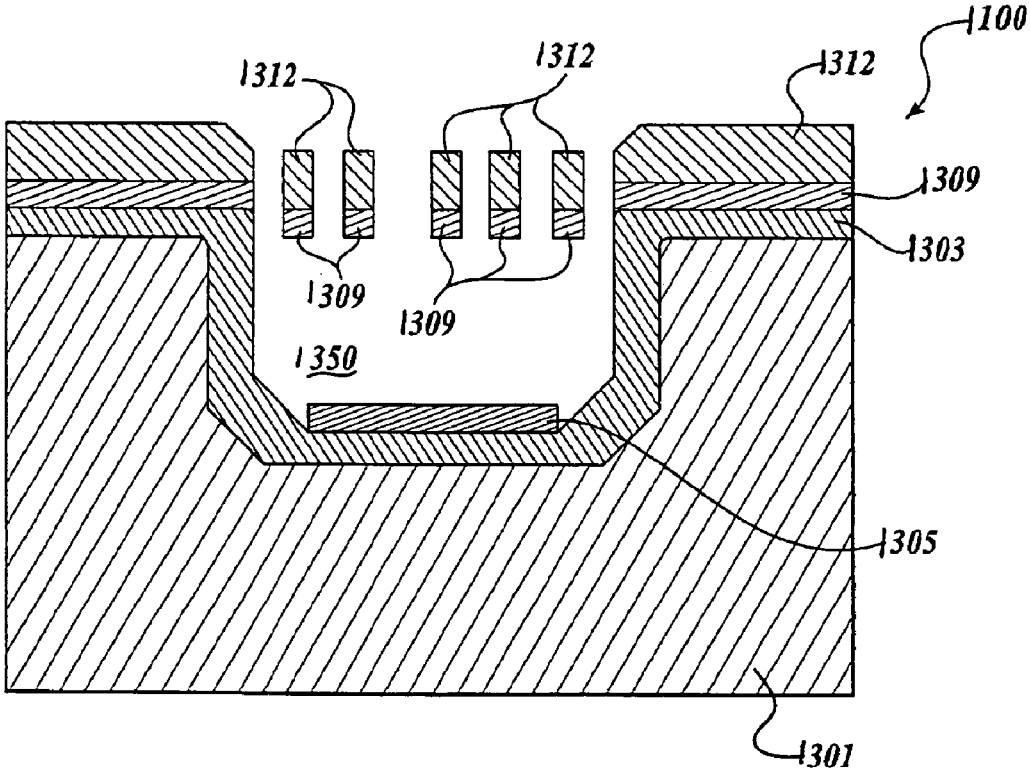

The grid 1312 may be formed by the use of any known fabrication process for shaping formed metallic layers. In one embodiment, the grid 1312 is formed by the use of a photo-resistive material 1310 or other appropriate material that is shaped by a mask. As shown in FIG. 11C, the photo-resistive material 1310 is applied to the top layer of the conductive layer 1309, and used to form the grid 1312. In this illustrative example, upon the removal of the photo-resistive material 1310, the grid 1312 is formed in a location that is vertically positioned above the anode 1305 as shown in FIG. 11D. Also shown in FIG. 11D, the etching process removes portions of the conductive layer 1309, thereby forming the conductive layer 1309 in the same shape and configuration as the grid 1312.

Similar to the construction of the anode 1305, the grid 1312 may be constructed from any conductive material. For instance, in several examples, the grid 1312 may be made of tungsten, gold, tantalum, nickel or any other like material. As described in more detail below with reference to FIG. 12C, the grid may comprise a plurality of apertures sized and configured to control the flow of electrons emitted from the cathode (1351 of FIG. 10). In this embodiment, the grid 1312 may have a thickness between 0.1 microns and one millimeter, and each aperture may be shaped into a square having 0.1 micron to more than one millimeter sides. In another embodiment, the grid can be configured to have the form of a conductor mesh with rectangular or other aperture shapes, suitable to microelectronic, micro electromechanical system (MEMS), micro-system-technology (MST), micromachining and other various metal fabrication and manufacturing techniques. In another embodiment, the grid 1312 is formed into a plurality of bars having a height and width ranging from 0.1 microns to more than one millimeter. In one embodiment, the bars are substantially aligned on a plane that is substantially parallel to the surface of the anode or cathode. The distance between the bars of the grid 1312 can be in the range of one micron to several centimeters. Although a range of one micron to several centimeters is utilized in these illustrative embodiments, the dimensions disclosed herein are provided for illustrative purposes only and are not to be construed to limit the scope of the present invention.

Also shown in FIGS. 11C-D, the fabrication process also involves the removal of the filling 1307. In this part of the fabrication process, the filling 1307 may be removed by exposing the filling 1307 to an appropriate wet or dry photo-etching process. In the removal of the filling 1307, the filling 1307 should be removed from the anode 1305 to expose the top surface of the anode 1305 to the grid 1312.

Although the embodiment of FIGS. 11C-D has a grid 1312 that is positioned near the opening of the cavity, the scope of the present invention also includes other embodiments where the grid 1312 is positioned at a height above or below the opening of the cavity 1350. For instance, in the above-described fabrication method, the filling 1307 may be configured to only fill half of the cavity 1350, thereby allowing the grid 1312 to form at a level below the opening of the cavity 1350. Alternatively, the filling 1307 may be configured to form a substantially flat, uniform surface above the opening of the cavity 1350, thereby allowing the formation of the grid 1312 to be at a position above the opening of the cavity 1350. There are many other techniques, methods, and ways including brazing, punching, spot welding, bonding, etc. to make the grid either singularly or in a combined fashion. For example, the grid can be secured directly on the top surface of the insulating substrate of ceramic, glasses, etc., similar to the anode, through various bonding and brazing techniques. In this example, the grid is separately fabricated using micro-electronic MEMS, MST, micromachining and other manufacturing techniques which may not require a filling process.

Figure 11E:
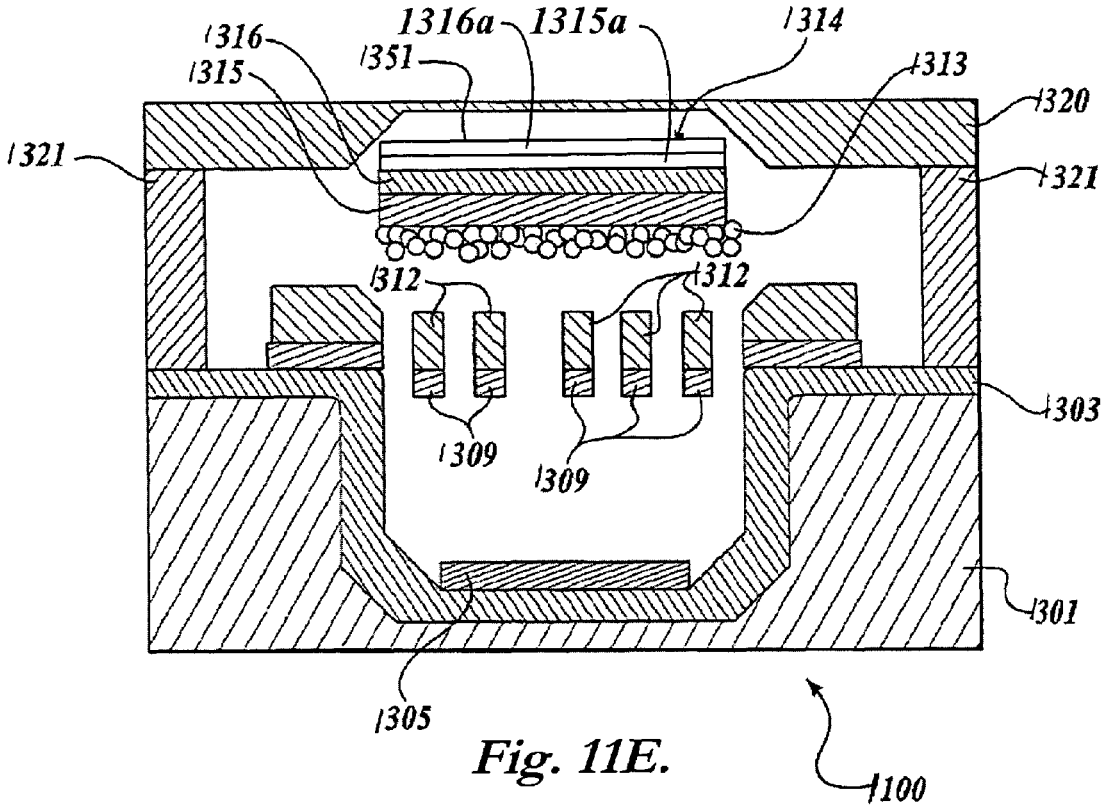

Referring now to FIG. 11E, the structure of one embodiment of the cathode 1351 is shown. Generally described, the cathode 1351 is formed into an air bridge structure that thermally isolates a heated electron emitting material 1313 on the cathode 1351 from other components of the triode 1100. As shown in FIG. 11E, the air bridge structure is suspended over a cavity 1314 of a base substrate 1320. In one embodiment, the air bridge is affixed to the substrate 1320 at opposite ends, leaving an open area between the cathode 1351 and the substrate 1320. In this illustrative embodiment, the air bridge structure of the cathode 1351 is in the form of an elongated member comprising an insulating layer 1316, conductive layer 1315 and an electron-emitting material 1313. In this embodiment, the conductive layer 1315 functions as a thermal source to apply heat directly to the electron-emitting material 1313.

Similar to the fabrication method described above with reference to FIGS. 11A-B, the air bridge structure of the cathode 1351 may be formed by a fabrication process that employs a filling material. The fabrication process of the cathode 1351 begins with a step where a cavity 1314 is etched into a base substrate 1320. The cavity 1314 may be etched into the substrate 1320 by a number of known fabrication processes, such as a wet etch, dry etch, or any other like method. In addition, the cavity 1314 may be formed to any depth sufficient for creating an air gap between the cathode 1351 and base substrate 1320. Similar to the first substrate 1301, the base substrate 1320 of the cathode 1351 may be made from any substrate material such as a single crystal, polycrystalline material, amorphous material, or any other semiconductor material. In yet another embodiment, the cavity 1314 can be, similar to the case of the anode, a through-hole type of cavity, which can involve insulating substrates made of ceramic, glass, etc.

Once the cavity 1314 is formed in the base substrate 1320, a filling material (not shown) is then placed in the cavity 1314. Similar to the filling 1307 described above, the filling material formed in the cavity 1314 provides a raised surface for the formation of the insulating and conductive layers 1316 and 1315. In a fabrication process similar to the fabrication method described above with reference to FIGS. 11A-B, the insulating and conductive layers 1316 and 1315 are disposed on the filling material. Either a subtractive approach, as described above, or additive approaches can be used to create a cavity for the "air" bridge structure.

The insulating layer 1316 can be made from any material having electrically resistive properties. For example, the insulating layer 1316 may be made of ceramic, silicon dioxide or the like. In one embodiment, the insulating layer 1316 is disposed on the filling material by the use of any generally known fabrication method such as wet oxidation, sputtering evaporation, or any other like method. The cathode 1351 further comprises a conductive layer 1315 disposed on the insulating layer 1316. In this embodiment, the conductive layer 1315 functions as a thermal source to heat the electron-emitting material 1313. In one embodiment, the conductive layer 1315 may be made of a low resistance metal that rises to high temperatures when a voltage source is applied thereto. Several examples of a conductive metal providing a thermal source include metals such as nickel, tantalum, platinum, tungsten, molybdenum, chromium/tungsten, titanium tungsten, other conductive alloys, intermetallics, or the like. Although these metals are used in this illustrative example, any other conductive materials for creating a heat source may be used in the construction of any one of the embodiments disclosed herein. The conductive material 1315 may be applied by a number of known fabrication methods, such as sputtering, evaporation, electroplating, CVD, etc. In the case of a through-hole type of cavity in the insulating substrate of ceramics, glasses, etc., various bonding techniques can be used to secure a conductor layer 1315 on the surface of the substrate 1320. In one embodiment, the insulating and conductive layers 1316 and 1315, respectively, each have a thickness in the range of less than 1 micron to greater than 1 millimeter. Although this range is used in this illustrative embodiment, the insulating and conductive layers 1316 and 1315 may be any other thickness greater or less than this range.

Figure 12B:
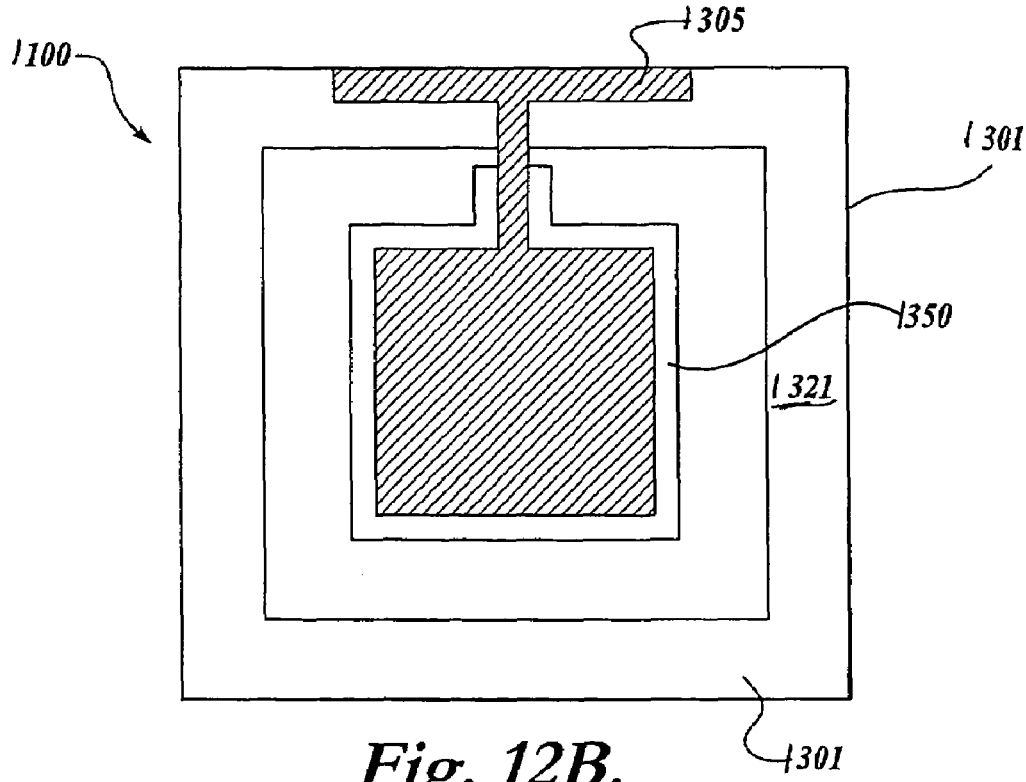
FIG. 12B is a top view of the substrate illustrated in FIG. 3A having an anode layer disposed thereon.
Figure 12C:
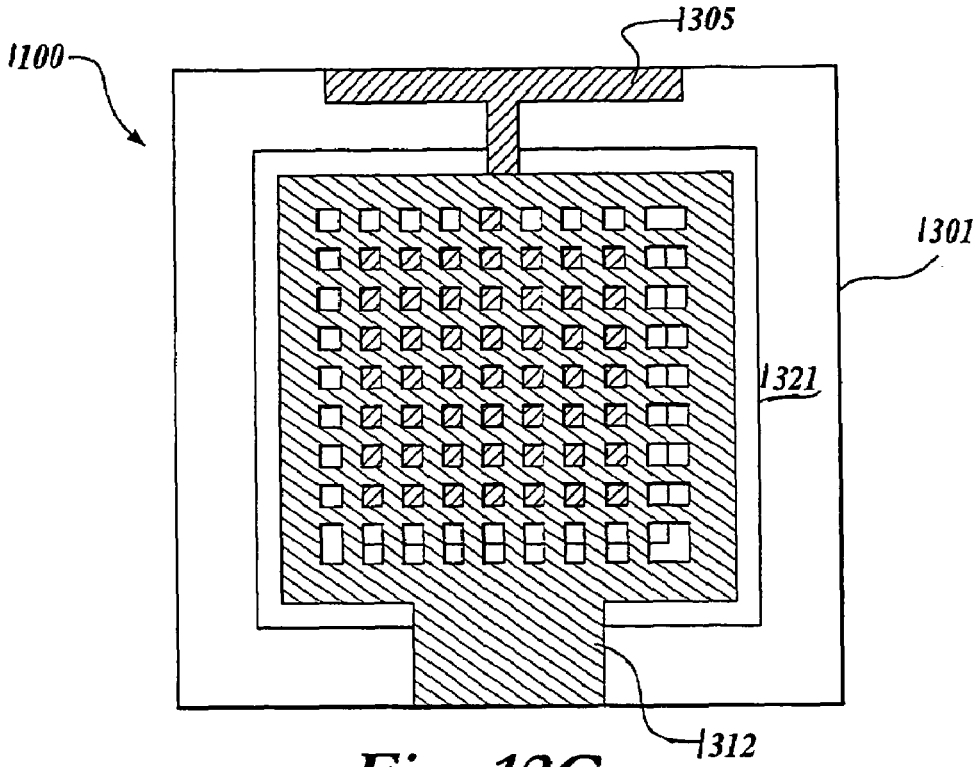
FIG. 12C is a top view of the substrate illustrated in FIG. 3B having a grid component disposed thereon.
Figure 12D:
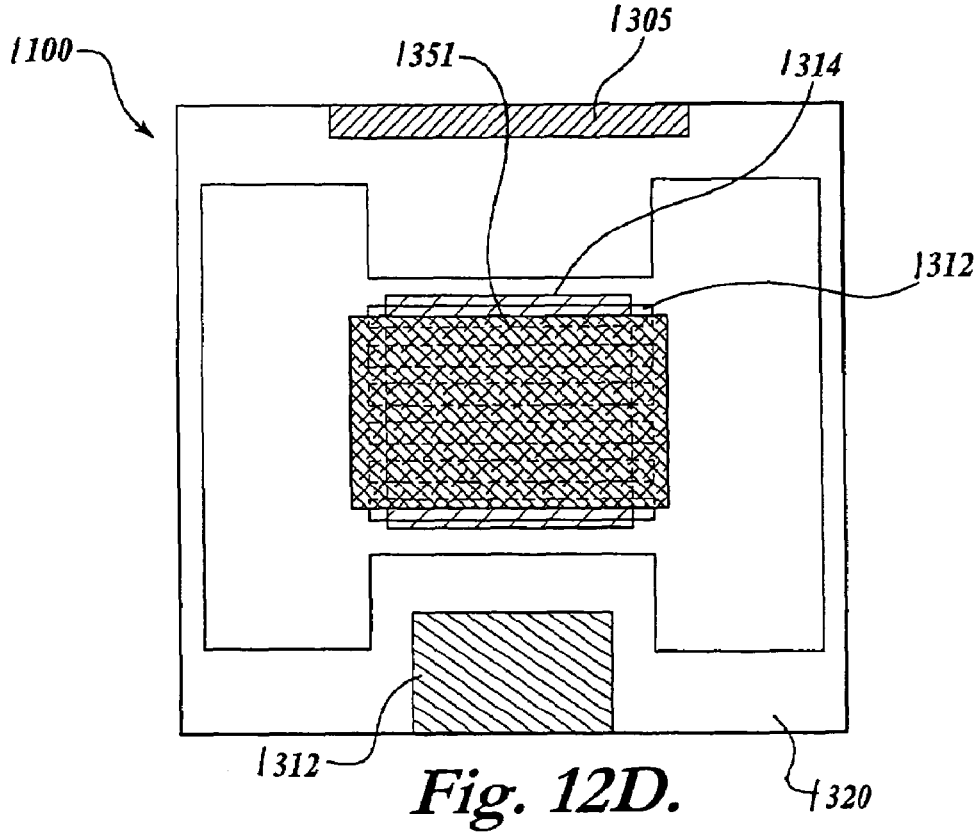
FIG. 12D is a top view of the substrate depicted in FIG. 3C having a cathode disposed thereon.

In one embodiment, the insulating and conductive layers 1316 and 1315 that form the cathode 1351 are affixed to the substrate 1320 at opposite ends of the air bridge. Referring to FIG. 12D, a top view of the cathode 1351 illustrates the configuration of the cavity 1314 in relation to the configuration of the conductive layers 1316 and 1315 that form the cathode 1351. As shown, the insulating and conductive layers 1316 and 1315 are sized and shaped to span over the cavity 1314, thus allowing the ends of the cathode 1351 to attach to the substrate 1320 near the opening of the cavity 1314. In another embodiments, the air bridge structure of the cathode 1351 may be attached to one, three or all sides of the cathode 1351. Once the cathode 1351 is formed, the filling material in the cavity 1314 may be removed by exposing the filling material to an appropriate wet or dry photo-etching process.

Once the conductive layers 1316 and 1315 are formed, the electron emitting material 1313 is disposed on the conductive layer 1315. In one embodiment, the electron emitting material 1313 may be a monocarbonate to a tricarbonate, or a suitable metal or mix of metals such as an alkaline with metal or mixtures thereof. In one embodiment the tricarbonate is deposited onto the cathode 1351 by a conventional procedure, such as electrophoresis. Alternatively, the electron emitting material 1313 may be sprayed onto the cathode 1351 surface. By these processes, carbonates of several elements such as strontium, calcium and barium can be deposited onto the conductive layer 1315. Although these examples are disclosed for illustrating one embodiment, any other low work function material may be used in the application of the electron emitting material 1313.

The above-described process is illustrative of one embodiment of a cathode that is directly heated. For indirectly heated cathodes, there are numerous embodiments that can be employed. For example, an additional insulating layer 1316*a* and an additional conducting layer 1315*a* can be established on the conductive layer 1315, or both the insulating layers 1316 and the conductive layer 1315 together as the indirectly heated cathode. In such an embodiment, the conductive layer 1315 or both the insulating layers 1316 and the conductive layer 1315 together function as the heater for the cathode. Electron emission materials, in this case, will be deposited on top of the cathode conductor. As of the conductor being bonded on the surface of the insulating substrate of ceramics, glasses, etc., this suspended conducting layer can be used as either the heater conductor or the cathode conductor depending on the manufacturing processes and applications of the devices. Subsequent buildup of either the heater or the cathode will follow accordingly.

In one embodiment of the above-described fabrication method, it may be preferred to remove the filling material under the air bridge structure after the electron emitting material 1313 is disposed on the conductive layer 1315. This embodiment allows the filling material to support the air bridge structure of the cathode 1351 during the application of the electron emitting material 1313.

Although a cathode 1351 having a conductive 1315 layer and insulating layer 1316 is disclosed as one illustrative embodiment, the cathode 1351 may comprise a variety of layers or combinations of layers to form the air bridge of the cathode 1351. For instance, in another embodiment, the cathode 1351 shown in FIG. 11E may comprise an additional second insulating layer and a second conductive layer disposed between the electron emitting material 1313 and conductive layer 1315. In this embodiment, the second insulating layer is directly deposited onto the conductive layer 1315 of the cathode 1351. The second insulating layer may be configured to any thickness and can be made from any material having electrically resistive properties. Next, the second conductive layer is disposed on the second insulating layer. The second conductive layer may be configured to any thickness and is made from any electrically conductive material such as tungsten, nickel, gold, tantalum, or any other like material. By the use of the fabrication process described above, the electron emitting material 1313 is then disposed on the second conductive layer.

In yet another embodiment, the cathode 1351 comprises a single conductive layer and an electron emitting material. In this embodiment, the single conductive layer is configured in a manner similar to the configuration of the insulating layer 1316 of FIG. 11E. More specifically, the single conductive layer of this embodiment is disposed on a filling material in the cavity and shaped to form an air bridge structure over the cavity when the filling material is removed. The single conductive layer may be configured to any thickness and is made from a low resistance metal that rises to high temperatures when a voltage source is applied thereto. The electron emitting material is then disposed directly onto the single conductive layer. In this embodiment, other optional layers may be positioned between the single conductive layer and the electron emitting material. For instance, an insulating layer may be positioned on the single conductive layer and a second conductive layer may be placed between the insulating layer and the electron emitting material.

Referring again to FIG. 11E, the cathode 1351 is affixed in a position such that the electron emitting material 1313 is vertically aligned above the cavity and oriented to face the grid 1312 and anode 1305. Also shown in FIG. 11E, the cathode 1351 is affixed to the first substrate 1301 by a seal 1321. The seal 1321 may be constructed of any material that is capable of holding the cathode 1351 structure to the first substrate 1301. The seal 1321 may be made of any material, such as silicon dioxide, of sufficient strength to hold the cathode 1351 in place. In addition, the seal 1321 should be made of a material having a sufficient strength for maintaining a controlled environment, such as a vacuum environment, around the cathode 1351, anode 1305 and grid 1312. The seal 1321 may be in any form, such as an elongated section of silicon dioxide (FIG. 11E) or a raised section of the first substrate 1301.

When the second substrate 1320 of the cathode 1351 is affixed to the first substrate 1301, all oxygen and other impure gasses are removed from the area surrounding the cathode 1351, grid 1312, and anode 1305. In one embodiment, a vacuum environment is formed in the enclosed area created by the seal 1321, first substrate 1301 and second substrate 1320. The pressure of a vacuum is often a controlled environment having an extremely reduced oxygen content, thus preventing oxidation as often degradation of the component and materials existing within the region of the controlled environment. Alternatively, the enclosed area created by the seal 1321, first substrate 1301 and second substrate 1320 may be filled with a gas that permits the flow of electrons between the cathode 1351 and anode 1305. Such examples of a filling gas include hydrogen, helium, argon, and mercury. In the construction of the through-hole embodiment, the outer surface of the through-hole in the substrate 1320 can be sealed by the use of another platform, such as a carrier of the circuit. This carrier can be microelectronic MEMS, MST, or other types of packaging materials such as semiconductors, ceramics, glasses, etc. Referring now to FIGS. 12A-D, a top view of various components of the triode 1100 is shown. In summary, FIGS. 12A-B illustrate the top view of one embodiment of the anode 1305 and cavity 1350 formed in the substrate 1301, and FIGS. 12C-D illustrate a top view of one embodiment of the cathode 1351 and grid 1107 positioned over the cavity 1351.

FIG. 12A illustrates one embodiment of a cavity 1350 formed in the substrate 1301. In this illustrative embodiment, the cavity 1350 is formed into a substantially square shape. The cavity 1350 also comprises an external groove to allow components to extend from the bottom of the cavity 1350 to a portion of the substrate 1301 that is external to the cavity 1350. As shown in FIG. 12B, the anode 1305 is disposed in the cavity 1350. Any one of the above-described fabrication methods may be utilized to form the anode 1305. Also shown in FIG. 12B, a portion of the anode 1305 is formed in the groove to extend from the cavity 1350 to a portion of the substrate 1301 that is external to the cavity 1350. The portion of the anode 1305 that is external to the cavity 1350 provides a communication path that allows external electronics, such as an anode voltage controller (1704 of FIG. 16), to communicate with the anode 1305.

Referring now to FIG. 12C, a top view of one embodiment of the grid 1312 is shown. As shown in FIG. 12C, this embodiment of the grid 1312 forms a substantially flat conductive layer that is vertically positioned over the cavity 1350 and anode 1305. The plane defined by the surface of the grid 1312 is substantially parallel to the plane defined by the surface of the anode 1305. Also shown in FIG. 12C, this embodiment of the grid 1312 has a number of apertures through grid 1312. In one embodiment, the dimension of each aperture may be approximately 500 square microns. Although a configuration of a grid having square apertures is utilized in this illustrative example, any grid 1312 having at least one aperture for allowing the passage of electrons can be utilized in forming any one of the embodiments disclosed herein. For instance, the grid can also be formed into elongated electrical conductors, conductors which form a grid pattern of a plurality of "wires" that are formed to influence the passage of electrons. In addition, the grid 1312 may be in any position relative to the anode 1305 and cavity 1350 so long as the grid 1312 allows the selective passage of electrons from the cathode 1351 to the anode 1305. The grid 1312 is also formed with an external contact for allowing an electrical connection between the grid 1312 and other external circuits.

Referring now to FIG. 12D, a top view of the triode 1100 illustrates the one embodiment of the cathode 1351 of the triode 1100. In one embodiment, the cathode 1351 is positioned vertically above the grid 1312 and configured with external contacts, or an equivalent thereof, for allowing external electronics to be electronically connected to cathode 1351. Although this embodiment of the cathode 1351 is formed in a square configuration, the cathode 1351 can be in any form that allows the cathode 1351 to emit charged carriers, such as electrons. In addition, FIG. 12D illustrates the orientation of the cavity 1314 in the cathode substrate 1320 relative to the orientation and configuration of the cathode 1351. As described above, the cathode 1351 is sized such that the ends of the cathode 1351 extend over walls of the cavity 1314 formed in the cathode substrate 1320. Thus, in this configuration, the ends of the cathode 1351 can be affixed to the cathode substrate 1320 near the opening of the cavity 1314. The cathode could be either a solid area covering part, all, or more than the heater conductive layers or a patterned layer having any appropriate shape.

Now that the fabrication process of one solid state vacuum device has been described in detail, several alternative embodiments will now be shown and described. More specifically, FIGS. 13-16 illustrate other triode embodiments and other devices such as a diode and pentode configuration. As can be appreciated by one of ordinary skill in the art, in view of the above-described fabrication process, other embodiments such as a diode and other higher order devices described below can be formed.

Figure 13:
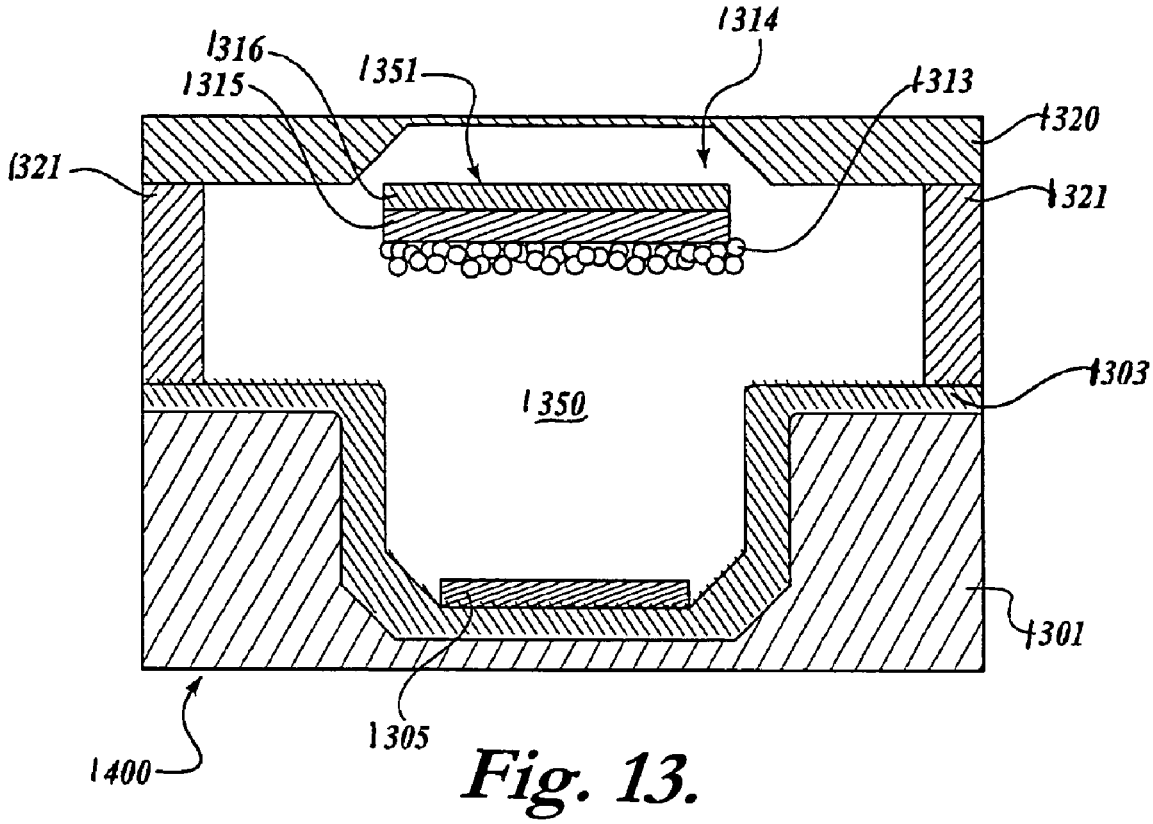
FIG. 13 is a side front cross-sectional view of one embodiment of a solid state vacuum device of the present invention in a diode configuration.

Referring now to FIG. 13, one embodiment of a solid state vacuum device forming a diode 1400 is shown and described below. Generally described, the diode 1400 comprises a substrate 1301 having a cavity 1350 etched into the substrate 1301. In addition, the diode 1400 also comprises an anode 1305 and a cathode 1351. In one embodiment, the cathode 1351 comprises a conductive layer 1315, insulating layer 1316, and an electron-emitting material 1313. The diode 1400 further comprises a seal 1321 for creating a vacuum environment in the area surrounding the anode 1305 and cathode 1351.

As shown in FIG. 13, the various components of the diode 1400 are constructed in a manner similar to the construction of the components described above with reference to the triode 1100 depicted in FIGS. 10-12D. For instance, the diode 1400 may comprise an oxidation layer 1303 having a thickness of 2 microns and a formed anode 1305 applied thereon. In addition, the cavity 1350, anode 1305, cathode 1351 and seal 1321 of this embodiment may be constructed by the use of a fabrication process similar to the fabrication process described above with reference to FIGS. 11A-E.

The operation of the diode 1400 is similar to that of a standard diode; however, in this embodiment, the diode 1400 is operated by the activation of the thermal source 1314. In response to activating the thermal source 1314, electrons are emitted from the cathode 1351 and received by the anode 1305. Similar to the triode 1100 of FIG. 10, the anode 1305 of the diode configuration produces a current source for an external circuit.

Figure 14:
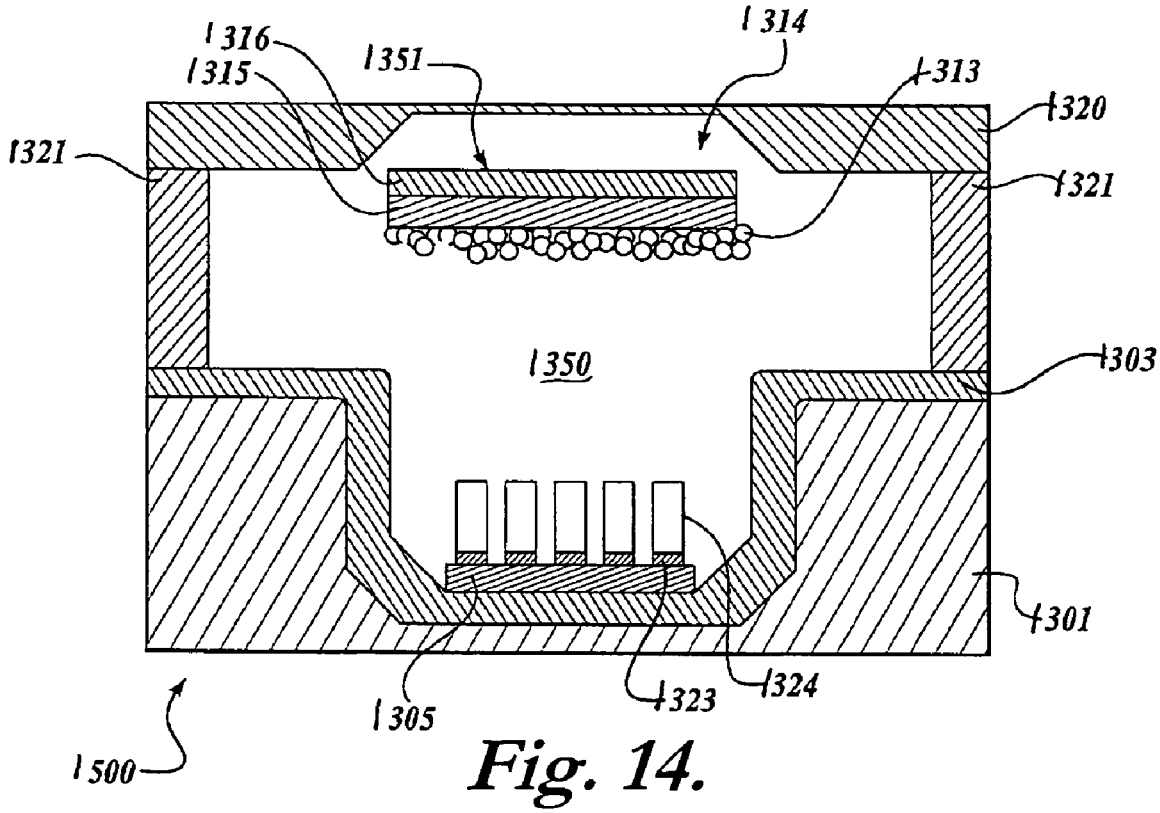
FIG. 14 is a side front cross-sectional view of one embodiment of a solid state vacuum device of the present invention in a tetrode configuration having a grid component disposed on an anode component.

Referring now to FIG. 14, one embodiment of a solid state vacuum device forming another embodiment of a triode 1500 is shown and described below. This embodiment of the triode 1500 comprises a substrate 1301 having a cavity 1350 etched into the substrate 1301. The triode 1500 further comprises an anode 1305 and cathode 1351. As shown, the anode 1305 and cathode 1351 are constructed in a manner similar to the anode 1305 and cathode 1351 of the embodiment illustrated in FIG. 10. In addition, the triode 1500 depicted in FIG. 14 comprises a grid 1324 that is disposed directly onto the anode 1305. Also shown in FIG. 14, this embodiment of the triode 1500 further comprises an insulating layer 1323 for providing electronic insulation between the anode 1305 and grid 1324.

As shown in FIG. 14, the various components of the triode 1500 are constructed in a manner similar to the construction of the components described above with reference to the triode 1100 depicted in FIGS. 10-12D. More specifically, the cavity 1350, anode 1305, cathode 1351 and seal 1321 of this embodiment may be constructed by the use of a fabrication process similar to the fabrication process described above with reference to FIGS. 11A-E. The insulating layer 1323 and grid 1324 of the embodiment are constructed in a manner similar to the construction of the oxidation layer 1303 and grid 1312 of the embodiment illustrated in FIGS. 10-12D. More specifically, the insulating layer 1323 may be made of any resistive material such as ceramic, silicone dioxide, silicon nitride, or any other like material. Any fabrication process used for depositing such a resistive material may be utilized to configure the insulating layer 1323. The grid 1324 is deposited onto the insulating layer 1323 by the use of any fabrication process capable of disposing a formed conductive layer. In one embodiment, the grid 1324 may be formed by the use of an etching process utilizing a photo-resistive material. In one embodiment, the grid 1324 may take the form of the grid (1312 of FIG. 12C) having a plurality of square apertures. The grid 1324 of this embodiment may be made of any conductive material and formed in any shape having at least one aperture for allowing the passage of electrons. The heights of each layer can be in the range of much less than 1 micron to greater than one millimeter.

Figure 15:
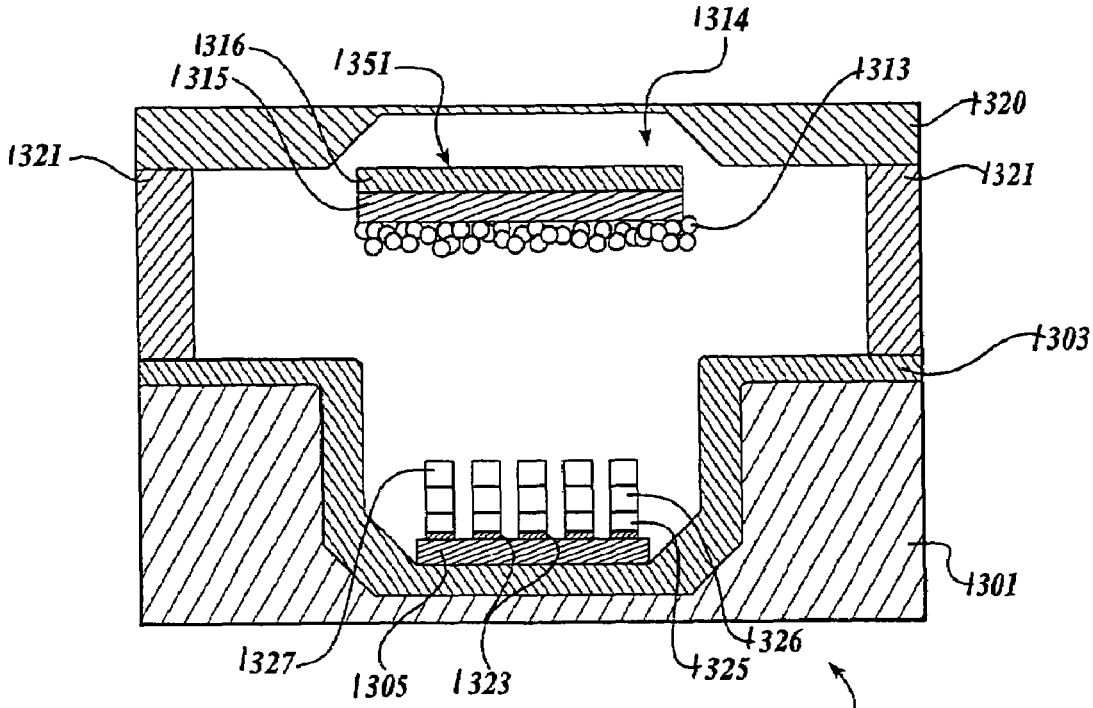
FIG. 15 is a side front cross-sectional view of one embodiment of a solid state vacuum device of the present invention in a tetrode configuration having two grid layers disposed on an anode component.

Referring now to FIG. 15, another embodiment of a solid state vacuum device forming a tetrode 1600 is shown and described below. Generally described, the tetrode 1600 comprises the general components of the triode 1500 illustrated in FIG. 14. For instance, the triode 1500 comprises an anode 1305 and cathode 1351 having the same configuration as the anode 1305 and cathode 1351 described above with reference to FIG. 11E. The tetrode 1600 further comprises two grid (electrode) layers 1325 and 1327 positioned between the anode 1305 and cathode 1351, and two insulating layers 1323 and 1326 respectively disposed next to each grid layer 1325 and 1327.

The two grid layers 1325 and 1327 of the tetrode 1600 of FIG. 15 have a configuration similar to the grid layer 1324 of the triode 1500 shown in FIG. 14. In one embodiment, each grid layer 1325 and 1327 may have a thickness in the range of one micron to one millimeter. In other illustrative embodiments, each grid layer 1325 and 1327 may have a thickness greater than one millimeter or less than one micron. In addition, each grid layer 1325 and 1327 may be configured in the form of a conductive layer having a plurality of apertures, as shown in the embodiment of FIG. 12C. Alternatively, each grid layer 1325 and 1327 may be configured in the form of a plurality of bars extending over the anode 1305. Similar to the triode 1500 of FIG. 14, grid layer 1325 and 1327 may be made from any conductive material, and the insulating layers 1323 and 1326 may be made from any electrically resistive material.

The construction of the tetrode 1600 involves a fabrication process similar to the above-described fabrication process (FIGS. 11A-E) for constructing the triode 1100 of FIG. 10. For instance, the substrate 1301 may be formed from the same fabrication process as described above with respect to the substrate 1301 shown in FIGS. 11A-E. The anode 1305 and cathode 1351 are also made by the process described above with respect to FIGS. 11A-E.

In the tetrode 1600 shown in FIG. 15, the configuration of the first grid layer 1325 and the first insulating layer 1323 is similar to the configuration of the grid layer 1324 and the insulating layer 1323 shown and described above with reference to FIG. 14. For example, as described above, the first grid layer 1325 and the first insulating layer 1323 may be configured by the use of a patterned mask layer and an effective etchant. The fabrication process for the tetrode 1600 also involves a second etching process to form the second insulating layer 1326 and second grid layer 1327 on top of the first grid layer 1325. The fabrication process (FIGS. 11A-E) utilizing the photo-resistive material may also be utilized to form second grid layer 1327.

Figure 16:
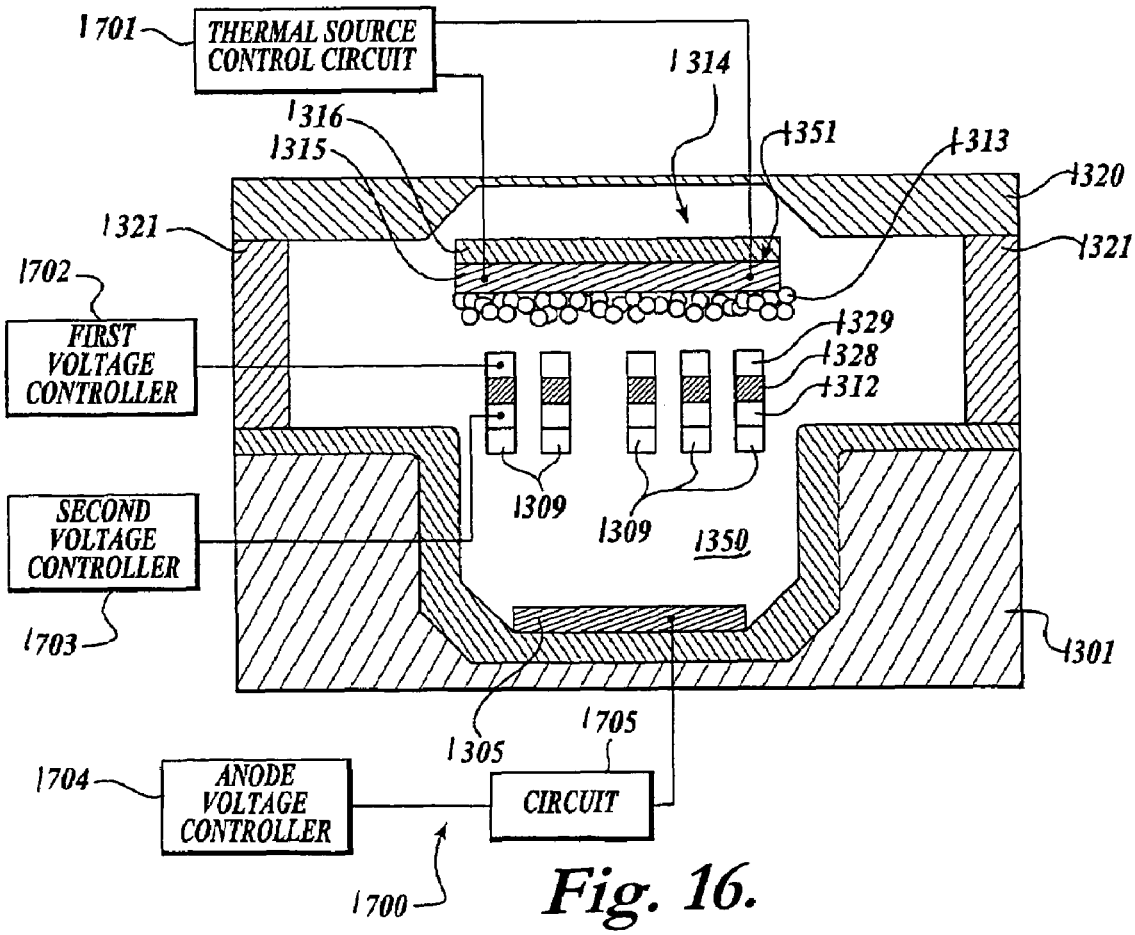
FIG. 16 is a side front cross-sectional view of one embodiment of a solid state vacuum device in a tetrode configuration having two grid layers suspended between a cathode and anode.

Referring now to FIG. 16, yet another embodiment of a solid state vacuum device forming a tetrode 1700 is shown and described below. Generally described, the tetrode 1700 comprises an anode 1305, cathode 1351, and a plurality of grid layers 1312 and 1329. The anode 1305 and cathode 1351 of this embodiment are constructed in a manner similar to the anode 1305 and cathode 1351 depicted in FIG. 11E and described above. The first grid layer 1312 and seal 1321 are also constructed in a manner similar to the grid layer 1312 and seal 1321 of the triode 1100 depicted in FIG. 11E. The first grid layer 1312 comprises at least one aperture for allowing the passage of electrons through the first grid layer 1312. The second grid layer 1329 is positioned above the first grid layer 1312, and the second grid layer 1329 is separated from the first grid layer 1312 by an insulating layer 1328. The second conductive layer 1309 can be another conductor, a low secondary-electron-emission conductor, or an insulating layer depending on applications and purpose.

In one embodiment, the first and second grid layers 1312 and 1329 are configured in the form of a conductive layer having a plurality of apertures, as shown in the embodiment of FIG. 12C. Alternatively, the first and second grid layers 1312 and 1329 may be configured in the form of a plurality of bars extending over the anode 1305. As described above, the first and second grid layers 1312 and 1329 may be made of any conductive material and formed in any shape having at least one aperture for allowing the passage of electrons.

The fabrication process for constructing the tetrode 1700 of FIG. 16 is similar to the fabrication process described above with reference to FIGS. 11A-E. In addition, the fabrication process for constructing the tetrode 1700 further comprises the fabrication of a second grid layer 1329. More specifically, the second grid layer 1329 and insulating layer 1328 are disposed onto an insulating layer 1328, by the use of any fabrication process for shaping formed layers. As applied to any of the tetrode configurations described herein, the two grids layers may be positioned such that the apertures of each grid layer align with one another. Adding another grid layer between the control grid and the anode helps to screen or isolate the control grid from the anode. This reduces the so-called Miller Effect, which has certain effects on the capacitance between the grid and the anode. The addition of another screen also causes an electron-accelerating effect, which increases the gain of the device. Also illustrated in FIG. 16, the various circuit components utilized in the operation of a solid state vacuum device, such as a tetrode 1700, are shown. As shown in FIG. 16, a thermal source control circuit 1701 is electronically connected to the conductive layer 1315, also referred to as the thermal source of the cathode 1314. The thermal source control circuit 1701 supplies a voltage to the conductive layer 1315 causing the conductive layer 1315 and the electron-emitting material 1313 to heat. Once brought to a sufficient temperature, the electron-emitting material 1313 emits electrons, which are ultimately received by the anode 1305.

In this illustrative example, an anode voltage controller 1704 is electronically connected to the anode 1305 for providing a positive voltage to the anode 1305 so that it attracts electrons emitted from the electron-emitting material 1313. As described above, in response to receiving electrons, the anode 1305 produces an electrical current that can be utilized by external circuitry 1705. A first voltage controller 1702 is electronically connected to one grid layer 1329 and a second voltage controller 1703 is electronically connected to the other grid layer 1328. Similar to a control circuit of a traditional tetrode formed in a vacuum tube, the first and second voltage controllers 1702 and 1703 provide a varied voltage signal to the grid layers 1312 and 1329 to control the flow of electrons received by the anode 1305. In other embodiments, any of the voltage controllers, such as the second voltage controller 1703, may be coupled to a ground source. Accordingly, the amount of electrons received by the anode effectively controls the current produced by the anode 1305. The current produced by the anode 1305 is then communicated to an external circuit 1705. Although this embodiment illustrates a tetrode having two independent voltage controllers for each grid, other embodiments having one or more control circuits can be used to control any number of grid layers of the solid state vacuum devices disclosed herein.

By the use of the fabrication methods disclosed herein, other higher order devices can be implemented by applying additional grid layers on top of the grid layers of any one of the embodiments described herein. The additional grid layers may be applied to any one of the disclosed embodiments by the use of any one of the above-described fabrication methods. For instance, in an example utilizing the embodiments of FIGS. 15-16, a solid state vacuum device may further comprise third and fourth grid layers positioned above the second grid layer (1327 of FIG. 15 and 1329 of FIG. 16) of a tetrode. In this example, an insulating layer, such as silicon dioxide, may be disposed on the second grid layer to provide a supporting surface for the third and fourth grid layers. Similar to the first and second grid layers, an insulating layer is sandwiched between the third and fourth grid layers to inhibit electrical communication between the grid layers. Such an embodiment is shown in the embodiment illustrated in FIG. 17.

Figure 17:
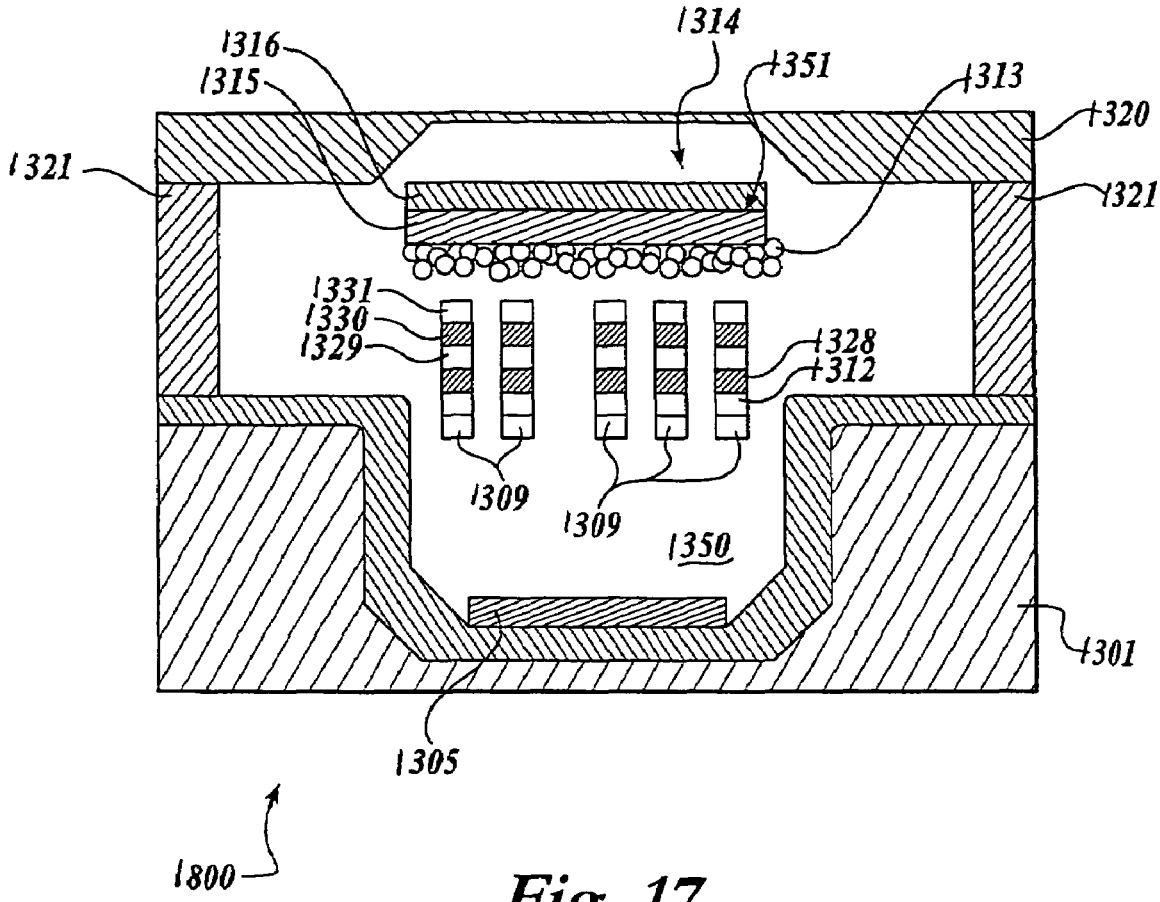
FIG. 17 is a side front cross-sectional view of one embodiment of a solid state vacuum device in a pentode configuration having three grid layers suspended between a cathode and anode.

The pentode device 1800 of FIG. 17 is similar in construction to the device shown in FIG. 16. However, the pentode device 1800 of FIG. 17 includes a more sophisticated grid construction. The cathode construction and location are similar as are the anode position and construction. The device of FIG. 16 presents two voltage controllers to control the grid. Voltages within the grid during construction of the grid of FIG. 17 permit these voltage controllers to be surpassed on the grid. (Voltage controller circuits are not shown). The composition of electrode 1331, 1329, and 1312 of the pentode 1800 are similar to the respective components of the tetrode 1700, while the components referenced as 1330 and 1328 are similar in composition, construction and purpose. Components 1329, 1328, 1312 as well as 1309 are all described with reference to FIG. 16. The pentode device 1800 is adapted to permit more control of electrons flowing from the cathode to the anode.

Employing such multi-grid devices, as described above, will result in improvements in the gain and frequency performance of the device. In conventional vacuum device manufacturing, it is difficult to achieve desired grid alignment due to the physical configuration of the grid. For example, in the form of a helix and the manufacturing method used to form the helix, such as wire winding. Accordingly, the methods, techniques and approaches of the present invention provide a better alignment of the multi-grids. In addition, the methods, techniques and approaches of the present invention provide an improved manufacturing process of such multi-grids.

While several embodiments of the invention have been illustrated and described, it will be appreciated that various changes can be made therein without departing from the spirit and scope of the invention. Similarly, any process steps described herein might be interchangeable with other steps in order to achieve the same result. In addition, the illustrative examples described above are not intended to be exhaustive or to limit the invention to the precise forms disclosed. For instance, as suggested by the cut-away view of FIG. 1, one embodiment of a solid-state vacuum device may comprise an array having a number of diodes, triodes, or any other higher-order devices combined onto one substrate. By fabricating duplicate devices, or various combinations thereof, on one substrate, high-power solid-state vacuum devices can be formed. In such a modification, each individual device should be separated and insulated from one another by the use of gaps or voids. In addition, such device arrays can be separated by a thermal insulator such as ceramic, silicon dioxide, sapphire, or the like.

The embodiments of the invention in which an exclusive property or privilege is claimed are defined as follows:

1. A solid state thermionic tetrode, comprising:

a first substrate having a cavity formed on one side with an insulating layer coating the one side and a surface of the cavity;

an anode formed in the cavity and adjacent to the insulating layer;

a grid structure, comprising:

a first conductive layer formed above the anode in the cavity;

a first insulating layer formed between the first conductive layer and the anode;

a second conductive layer formed between the first insulating layer and the anode; and a plurality of slots passing through the grid structure to allow passage of electrons therethrough;

a second substrate opposite the first substrate having a void formed therein;

a cathode disposed between the void and the first conductive layer;

a means for heating the cathode; and a seal between the first and the second substrates to enclose the cavity, the grid structure and the void of the tetrode in a controlled environment.

2. The tetrode according to claim 1, further comprising a grid formed adjacent to and between the first insulating layer and the second conductive layer.

3. The tetrode according to claim 1, further comprising a third insulating layer formed on a first side of the cathode and adjacent to the void.

4. The tetrode according to claim 3, further comprising an electron emitting layer formed on a second side of the cathode and between the first conductive layer and the cathode.

5. The tetrode according to claim 1, wherein the first insulating layer is in contact with and between the first and second conducting layers.

6. The tetrode according to claim 1, further comprising a second insulating layer between the anode and the second conductive layer.

7. The tetrode according to claim 6, wherein the second insulating layer is in contact with the anode and the second conductive layer.

8. The tetrode according to claim 7, wherein the first insulating layer is in contact with and between the first and second conducting layers.

9. A solid state thermionic pentode, comprising:

a first substrate having a cavity formed on one side with an oxide layer coating the one side and a surface of the cavity;

an anode formed in the cavity and adjacent to the oxide layer;

a grid structure, comprising:

a first electrode formed above the anode in the cavity;

a first insulating layer formed between the first electrode and the anode;

a second electrode formed between the first insulating layer and the anode;

a second insulating layer formed between the second electrode and anode; and a third electrode formed between the second insulating layer and the anode; and a plurality of slots passing through the grid structure to allow passage of electrons therethrough;

a second substrate opposite the first substrate having a void formed therein;

a cathode disposed between the void and the first electrode;

a means for heating the cathode; and a seal between the first and the second substrates to enclose the cavity, the grid structure and the void of the pentode in a controlled environment.

10. The pentode according to claim 9, wherein the first electrode, the first insulating layer, the second electrode, the second insulating layer and the third electrode are stacked together as an air bridge between the cavity and the void.

11. The pentode according to claim 9, further comprising a third insulating layer formed on a first side of the cathode and adjacent to the void.

12. The pentode according to claim 9, further comprising an electron emitting layer formed on a second side of the cathode and between the first electrode and the cathode.

13. The pentode according to claim 9, further comprising a conductive layer between the third electrode and the anode.

14. A solid state thermionic triode, comprising:

a first substrate having a cavity formed on one side with an oxide layer coating the one side and a surface within the cavity;

an anode disposed within the cavity and adjacent to the oxide layer;

a grid structure, comprising;

a grid disposed above the anode near the cavity;

a first conducting layer disposed on a surface of the grid closest to the anode; and a plurality of slots passing through the grid structure to allow passage of electrons therethrough;

a second substrate opposite the first substrate having a void formed in one side thereof;

a cathode disposed between the void and the grid;

a means for heating the cathode; and a seal between the first and the second substrates to enclose the cavity and the void of the triode.

15. The pentode according to claim 14, wherein the conductive layer is adjacent to the third electrode.

16. The triode according to claim 15, wherein the cathode further comprises:

a first insulating layer;

a second conducting layer disposed on the first insulating layer;

a second insulating layer disposed on the second conducting layer;

a third conducting layer disposed on the second insulating layer;

an electron emitting material disposed on the third conductive layer, and wherein the first insulating layer is adjacent to the void and the electron emitting material is opposite the grid.

17. A solid state thermionic triode, comprising:

a first substrate having a cavity formed on one side with an oxide layer coating the one side and a surface within the cavity;

an anode disposed within the cavity and adjacent to the oxide layer;

a grid disposed above the anode near the cavity;

a first conducting layer disposed on a surface of the grid closest to the anode;

a second substrate opposite the first substrate having a void formed in one side thereof;

a cathode disposed between the void and the grid;

a means for heating the cathode; and a seal between the first and the second substrates to enclose the cavity and the void of the triode.

18. The triode according to claim 17, wherein the cathode further comprises:

a first insulating layer;

a second conducting layer disposed on the first insulating layer;

a second insulating layer disposed on the second conducting layer;

a third conducting layer disposed on the second insulating layer;

an electron emitting material disposed on the third conductive layer, and wherein the first insulating layer is adjacent to the void and the electron emitting material is opposite the grid.

19. The triode according to claim 17, wherein the grid and first conducting layer further comprise a plurality of apertures to allow passage of electrons from the cathode to the anode.

20. The triode according to claim 17, wherein the grid and first conducting layer further comprise a plurality of slots to allow passage of electrons from the cathode to the anode.

* * * * *